US006051361A

United States Patent [19]

Hattori et al.

[11] Patent Number: 6,051,361

[45] **Date of Patent: *Apr. 18, 2000**

[54] LIGHT SENSITIVE COMPOSITION AND IMAGE FORMING MATERIAL

[75] Inventors: Ryoji Hattori; Shinji Kudo, both of Hino, Japan

[73] Assignee: Konica Corporation, Tokyo, Japan

[ * ] Notice: This patent is subject to a terminal disclaimer.

[21] Appl. No.: 09/123,063

[22] Filed: Jul. 27, 1998

[30] Foreign Application Priority Data

Sep. 18, 1997 [JP] Japan ..... 9-253553

[51] Int. Cl.[7] ..... G03C 1/73

[52] U.S. Cl. ..... 430/270.1; 430/283.1; 430/286.1; 430/193

[58] Field of Search ..... 430/270.1, 286.1, 430/283.1, 193

[56] References Cited

U.S. PATENT DOCUMENTS

| | | | |
|---|---|---|---|
| 4,247,611 | 1/1981 | Sander et al. | 430/286 |
| 4,816,375 | 3/1989 | Aoai | 430/270 |
| 5,153,095 | 10/1992 | Kawamura et al. | 430/175 |
| 5,340,699 | 8/1994 | Haley et al. | 430/302 |
| 5,723,253 | 3/1998 | Higashino et al. | 430/166 |
| 5,919,601 | 7/1999 | Nguyen et al. | 430/278.1 |
| 5,932,392 | 8/1999 | Hirai et al. | 430/270.1 |

FOREIGN PATENT DOCUMENTS

| | | | |
|---|---|---|---|
| 0 589 309 A1 | 3/1994 | European Pat. Off. | G03F 7/004 |
| 0 672 954 A2 | 9/1995 | European Pat. Off. | G03F 7/038 |
| 0 784 233 A1 | 7/1997 | European Pat. Off. | G03F 7/038 |
| 0 795 789 A1 | 9/1997 | European Pat. Off. | G03F 7/038 |
| 0 823 659 A1 | 2/1998 | European Pat. Off. | G03F 7/004 |
| 0 884 647 A1 | 12/1998 | European Pat. Off. | G03F 7/004 |

OTHER PUBLICATIONS

Patent Abstracts of Japan, vol. 098, No. 013, Nov. 30, 1998 of JP 10 207056 A, Aug. 7, 1998.

*Primary Examiner*—Janet Baxter
*Assistant Examiner*—Barbara Gilmore
*Attorney, Agent, or Firm*—Frishauf, Holtz, Goodman, Langer & Chick, P.C.

[57] ABSTRACT

Disclosed is a light sensitive composition comprising a compound capable of generating an acid on exposure of actinic light, one of a compound having a chemical bond capable of being decomposed by an acid and a compound having a group cross-linking by an acid, an infrared absorber, a polymer obtained by polymerization of a polymerizable composition comprising an ethylenically unsaturated monomer having a solubility parameter (SP value) of 13 or more.

17 Claims, No Drawings

LIGHT SENSITIVE COMPOSITION AND IMAGE FORMING MATERIAL

FIELD OF THE INVENTION

The present invention relates to a light sensitive composition including a positive working light sensitive composition capable of being solubilized by actinic light irradiation or a negative working light sensitive composition capable of being insolubilized by actinic light irradiation, an image forming material employing the composition and its manufacturing method. The present invention relates particularly to a light sensitive composition, which is suitable for an image forming material capable of being exposed to infrared rays such as a semiconductor laser to form an image, and an image forming material employing the composition.

BACKGROUND OF THE INVENTION

As an image forming material (hereinafter referred to also as a light sensitive material) comprising a positive working light sensitive layer to be solubilized by actinic light irradiation, an image forming material comprising a light sensitive layer containing an acid generating compound and an acid decomposable compound is known. That is, a light sensitive composition containing an acid generating compound and a water insoluble compound having a specific group capable of decomposed by an acid is disclosed in U.S. Pat. No. 3,779,779, a light sensitive composition containing an acid generating compound and a compound having an acetal or a ketal in the main chain is disclosed in Japanese Patent O.P.I. Publication No. 53-133429/1978, and a light sensitive composition containing an acid generating compound and a compound having a silylether group is disclosed in Japanese Patent O.P.I. Publication No. 65-37549/1985. These compositions have sensitivity in the ultraviolet range, which are capable of being alkali solubilized by imagewise ultraviolet ray exposure to provide non-image portions at exposed portions and to provide image portions at non-exposed portions. The imagewise ultraviolet ray exposure is generally carried out through a mask film by employing ultraviolet rays emitted from a light source such as a halogen lamp or a high pressure mercury lamp, or can be carried out by employing a short wavelength laser such as an argon laser or a helium-cadmium laser. However, these light sources are expensive, and troublesome in using due to its large size. Further, the above described light sensitive materials could not necessarily provide a satisfactory result in view of sensitivity.

In order to increase sensitivity of a light sensitive layer, to improve a chemical resistance of a light sensitive layer to various cleaners for cleaning a printing surface, or to improve an aptitude of a light sensitive layer to a ball-point pen ink, the present inventors have proposed a positive working light sensitive material controlling a dipole moment by adding a specific polymer to a light sensitive layer (Japanese Patent Application No. 9-5315) or a positive working light sensitive material comprising an o-quinonediazide compound and a polymer containing an aromatic monomer unit (Japanese Patent Application No. 6-329987). However, the imagewise exposure employing ultraviolet rays still has the problems as described above. A simple and less expensive exposure method has been eagerly sought.

A technique for forming an image by irradiation of infrared rays such as a cheap and compact semiconductor laser is proposed. In U.S. Pat. No. 5,340,699 is disclosed an image forming material comprising a light sensitive layer containing an acid generating compound, a resol resin, a melamine resin, a novolak resin and an infrared absorber, wherein a negative image is formed by a method comprising imagewise exposing the material to infrared rays, heating the exposed material before development, and then developing the heated material, or a positive image is formed by a method comprising imagewise exposing the material to infrared rays, and then developing the exposed material without heating. However, the method forming a negative image requires the heat treatment, resulting in much electrical power consumption or more load to the processor. The method forming a positive image has a problem in that the light sensitive layer contains much of a residual solvent and the light sensitive layer at image portions is likely to be partially or entirely dissolved in a developer. For example, when a presensitized planographic printing plate (one embodiment of the image forming material of the invention) comprising the above described light sensitive layer is imagewise exposed to infrared rays and developed with a developer, the layer at image portions may be damaged by the developer, although the damage depends upon the concentration of the developer. That is, there may occur a phenomenon called "layer damage", which is caused due to low resistance of the layer to developer. Further, the developed plate (printing plate), which is obtained from the presensitized planographic printing plate, has a problem in that the light sensitive layer at image portions may be damaged by chemicals used during printing due to low resistance to chemicals used during printing. Furthermore, sensitivity fluctuation after long-term storage is large, and the conventional image forming material is not satisfactory in view of storage stability.

SUMMARY OF THE INVENTION

The present invention has been made in view of the above.

A first object of the invention is to provide a light sensitive composition with high sensitivity to infrared rays, which is capable of being imagewise exposed to infrared rays to form a positive or negative image. A second object of the invention is to provide a light sensitive composition having excellent developability, excellent resistance to chemicals and excellent storage stability with no sensitivity fluctuation after long-term storage.

A third object of the invention is to provide an image forming material employing the above light sensitive composition.

DETAILED DESCRIPTION OF THE INVENTION

The above object of the invention can be attained by the followings:

(1) a light sensitive composition comprising a compound capable of generating an acid on exposure of actinic light, a compound having a chemical bond capable of being decomposed by an acid, an infrared absorber, and a polymer obtained by polymerization of a polymerizable composition comprising an ethylenically unsaturated monomer having a solubility parameter (SP value) of 13 or more.

(2) a light sensitive composition comprising a compound capable of generating an acid on exposure of actinic light, a compound having a chemical bond capable of being decomposed by an acid, an infrared absorber, and a polymer obtained by polymerization of a polymerizable composition comprising a first monomer (a) with a dipole moment of 3.0 D or more and a second monomer (b) with a dipole moment of less than 3.0 D, and Y represented by the following formula (1) being from 1.8 to 4.0:

formula (1)

$$Y=\Sigma(\mu a\times Ma)/100+\Sigma(\mu b\times Mb)/100$$

wherein $\mu a$ represents a dipole moment of the first monomer, $\mu b$ represents a dipole moment of the second monomer, Ma represents a polymerized first monomer content (mol %) of the polymer, and Mb represents a polymerized second monomer content (mol %) of the polymer.

(3) a light sensitive composition comprising a compound capable of generating an acid on exposure of actinic light, a compound having a chemical bond capable of being decomposed by an acid, an infrared absorber, and a polymer having an amido group.

(4) a light sensitive composition comprising a compound capable of generating an acid on exposure of actinic light, a compound having a chemical bond capable of being decomposed by an acid, an infrared absorber, and a polymer having an acid value of 5 or less.

(5) a light sensitive composition comprising a compound capable of generating an acid on exposure of actinic light, a compound having a chemical bond capable of being decomposed by an acid, an infrared absorber, and a polymer having an amino group.

(6) The light sensitive composition of item (1), (2), (3), (4) or (5), wherein the compound having a chemical bond capable of being decomposed by an acid is replaced by a compound having a group cross-linking by an acid.

(7) An image forming material comprising a support and provided thereon, a light sensitive layer containing the light sensitive composition of item 1, 2, 3, 4, 5, or 6.

It is preferable that the polymer having an amido group further has a phenolic hydroxy group, the polymer has an amido group-containing unit content of 5 to 50 weight %, and a phenolic hydroxy group-containing unit content of 10 to 80 weight %, the polymer has a weight average molecular weight (Mw) of $10^4$ to $10^8$, the polymer is a mixture of a polymer having an amido group with a weight average molecular weight (Mw) of $10^4$ to $5\times10^4$ and a polymer having an amido group with a weight average molecular weight (Mw) of $10^5$ to $10^7$, or the polymer has a methacryl amide unit and at least one unit selected from the group consisting of the following formulas (a) through (h):

Formula (a)

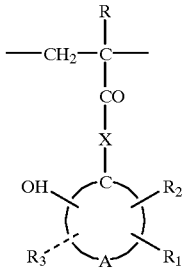

Formula (b)

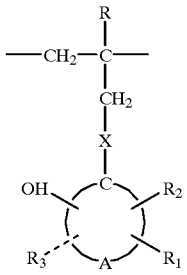

Formula (c)

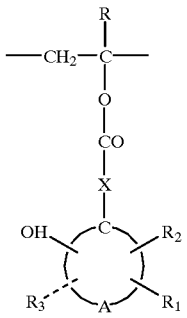

Formula (d)

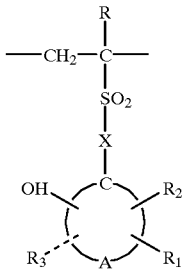

-continued

Formula (e)

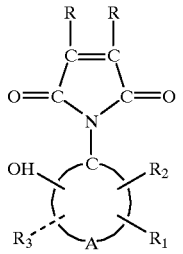

Formula (f)

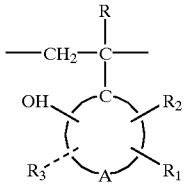

Formula (g)

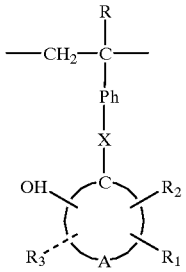

Formula (h)

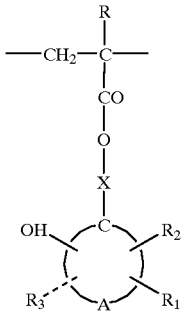

wherein R represents a hydrogen atom, a phenyl group or an alkyl group; $R_1$, $R_2$ and $R_3$ may be the same as or different from each other, and independently represent a hydrogen atom, an alkyl group, a sulfoamino group, a halogen atom, an alkoxycarbonyl group, a carbonyl group, an aryl group, an acyloxy group, an aralkyl group, an aryloxy group, an acryloyl group, an acyl group, an aminocarbonyl group or an alkoxy group; X represents an ether group, an ester group, an alkylene group, an arylene group, an alkylene carbonyloxy or arylenecarbonyloxy group, an amido group, a sulfonylamino group, an imino group, an alkyleneoxy group, or an aryleneoxy group; and A represents a non-metallic atom group necessary to form an aromatic group.

The preferable includes a light sensitive composition of item (1), (2), (3), (4), or (5), wherein the composition comprises another acrylic polymer, and an image forming material of item (7), wherein the support is an aluminum plate.

The present inventors have made an extensive study on a light sensitive composition, which is capable of being imagewise exposed to infrared rays to form an image, providing excellent developability, excellent chemical resistance, and excellent storage stability with no sensitivity fluctuation after long-term storage, and an image forming material comprising the composition. As a result, the present inventors have found that a light sensitive layer strength containing a specific polymer as a binder can attain the above object, which has solved the above problems in the light sensitive composition capable being exposed to infrared rays to form an image, and have completed the present invention.

The present invention will be detailed below.

The present invention relates to a light sensitive composition, and an image forming material employing the composition, which will be detailed below in order.

[1] Light Sensitive Composition

The light sensitive composition of the invention is divided into two types, a negative working light sensitive composition and a positive working light sensitive composition according to its working function. The negative working light sensitive composition includes the light sensitive composition of items 1 through (5) above, except that the compound having a chemical bond capable of being decomposed by an acid is replaced by a compound having a group cross-linking by an acid.

The polymer used in the light sensitive composition of items (1) through (5) described above will be explained below.

(1) Polymer described in item (1) above

This polymer is a polymer obtained by polymerization of a polymerizable composition comprising an ethylenically unsaturated monomer having a solubility parameter (SP value) of 13 or more. The Examples thereof includes a styrene copolymer and a vinyl type copolymer. The examples of the monomer having a solubility parameter (SP value) of 13 or more includes maleic anhydride, 3-cyanophenylmethacrylamide, p-aminosulfonylphenylmethacrylamide, 4-hydroxyphenylmethacrylamide, 4-hydroxyphenylacrylamide, 4'-acetoanilidemethacrylanilide, 4'-amidomethacrylanilide, methacrylamide, N,N-dimethylacrylamide, N-(p-toluenesulfonyl)methacrylamide, and N-(2-hydroxymethyl)-methacrylamide. The polymer may contain these monomer in an amount of 1 weight % or more, and the polymer containing these monomers have a solubility parameter of preferably 10 or more, and more preferably 10 to 15.0. The polymer having a monomer with an sp value of 13 or more is advantageous in high chemical resistance. The above polymer has a molecular weight of preferably $5\times10^3$ to $8\times10^4$, and more preferably $5\times10^3$ to $5\times10^4$. The light sensitive composition of the invention contains the polymer having the monomer having an sp value of 13 or more in an amount of preferably 5 to 80 weight %, and more preferably 10 to 60 weight %.

The solubility parameter of the monomer is described in "Polymer Handbook", John Wiley & Sons, or is calculated according to a calculating method of Fedors, and Small.

(2) Polymer described in item (2) above

This polymer is a polymer obtained by polymerization of a polymerizable composition comprising the following monomer (a) and monomer (b), satisfying the condition of Y represented by the above formula (1) as above described.

(a): a monomer with a dipole moment of 3.0 D or more (b): a monomer with a dipole moment of less than 3.0 D The example thereof will be described below.

The monomer (a) includes acrylonitrile, 3-cyanophenylmethacrylamide, 4-cyanophenylmethacrylate, methacrylamide, and 4'-amidomethacrylanilide.

The monomer (b) includes benzyl(meth)acrylate, cyclohexyl(meth)acrylate, dicyclopentanyl(meth)acrylate, isobornyl(meth)acrylate, phenoxyethyl(meth)acrylate, phenoxydiethyleneglycol(meth)acrylate, phenoxytetraethyleneglycol(meth)acrylate, phenoxyhexaethyleneglycol(meth)acrylate, phenoxylated phosphoric acid (meth)acrylate (modified ethylene oxide), phthalic acid (meth)acrylate (modified ethylene oxide), 4-hydroxyphenyl(meth)acrylamide, a carboxy group-containing compound such as (meth)acrylic acid or itaconic acid, methyl (meth)acrylate, a dibasic acid ester such as a half ester of maleic acid with hydroxyalkyl(meth)acrylate, ethyl (meth)acrylate, propyl (meth)acrylate, butyl (meth) acrylate, isobutyl (meth)acrylate, 2-hydroxyethyl (meth) acrylate, 2-ethylhexyl (meth)acrylate, octadecyl (meth) acrylate, lauryl (meth)acrylate, tridecyl (meth)acrylate, stearyl (meth)acrylate, 2-hydroxydodecyl (meth)acrylate, α-methylstyrene, diacetone acrylamide, methoxyethyl (meth)acrylate, ethoxyethyl (meth)acrylate, and butoxyethyl (meth)acrylate.

The polymer of this type is a polymer containing a unit from monomer (a) and a unit from monomer (b), and having Y, represented by the above formula (1), being 1.8 to 4.0. The example thereof includes a styrene copolymer and a vinyl type copolymer.

The above polymer has a molecular weight of preferably $5\times10^3$ to $8\times10^4$, and more preferably $5\times10^3$ to $5\times10^4$. The light sensitive composition of the invention contains the polymer in an amount of preferably 5 to 80 weight %, and more preferably 10 to 60 weight %.

Dipole moment can be measured according to dielectimetry or a molecular beam method, but dipole moment in the invention, is measured according to microwave spectrometry in which the dipole moment is obtained from polarization degree due to Stark effect of microwave absorption spectrum.

(3) Polymer described in item (3) above

The polymer used in the light sensitive composition of the invention is preferably a polymer having an amido group. Such a polymer can be used without any limitations, as long as it has an amido group. The examples thereof include polyamide, polyether, polyester, polycarbonate, polystyrene, polyurethane, polyvinyl chloride or its copolymer, a vinyl butyral resin, a vinyl formal resin, a shellac resin, an epoxy resin, a phenol resin, an acryl resin, and a water insoluble and dispersion resin (see Japanese Patent O.P.I. Publication No. 8-202048), each containing an amido group. In the invention, a styrene polymer having an amido group and a vinyl type copolymer having an amido group are preferable, and a vinyl type copolymer having an amido group is especially preferable. The example of a monomer having an amido group includes 3-cyanophenylmethacrylamide, morpholineethylmethacrylamide, 4-methoxyphenylmethacrylamide, 4-methylcarbonylphenylmethacrylamide, p-aminosulfonylphenylmethacrylamide, N-(4-hydroxy) phenylmethacrylamide, N-(4-hydroxy)phenylacrylamide, 4'-acetoanilidomethacrylanilide, 4'-amidomethacrylanilide, methacrylamide, N,N-dimethylacrylamide, N-(p-toluenesulfonyl)acrylamide, N-(p-toluenesulfonyl) methacrylamide, N-methylolacrylamide, N-(2-hydroxymethyl)acrylamide, N-(2-hydroxymethyl) methacrylamide, acrylamide, N-ethylacrylamide, N-hexylacrylamide, N-cyclohexylacrylamide, N-pheylacrylamide, N-nitro-pheylacrylamide, N-ethyl-N-pheylacrylamide, and acryloylmorpholine. The polymer in the invention can be a copolymer containing these monomer in an amount of 1 weight % or more, and preferably has a solubility parameter of 10 or more.

The polymer in the invention has preferably a hydroxy group, and especially preferably has a phenolic hydroxy group. The example thereof includes o-, p-, or m-hydroxystyrene, o-, p-, or m-hydroxyphenyl(meth) acrylate, N-hydroxyphenylmaleimide, N-(4-hydroxyphenyl) acrylamide, N-(4-hydroxyphenyl)methacrylamide, and vinyl phenol, but is not limited thereto.

The polymer has preferably at least one unit selected from the group consisting of the following formulas (a) through (h):

Formula (a)

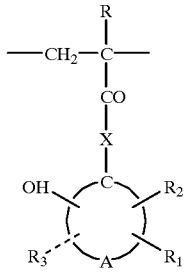

Formula (b)

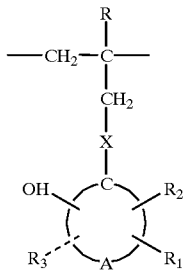

Formula (c)

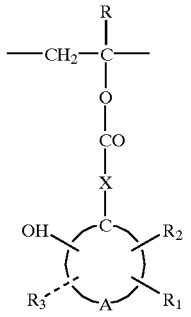

Formula (d)

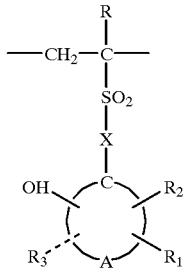

-continued

Formula (e)

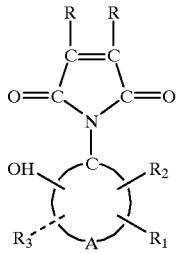

Formula (f)

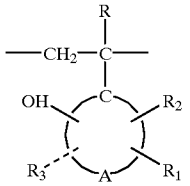

Formula (g)

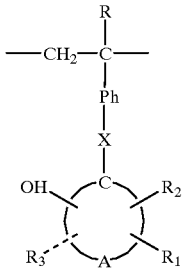

Formula (h)

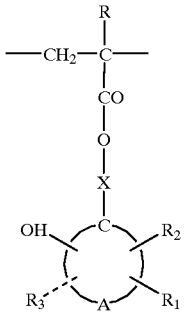

wherein R represents a hydrogen atom, a phenyl group or an alkyl group; $R_1$, $R_2$ and $R_3$ may be the same as or different from each other, and independently represent a hydrogen atom, an alkyl group, a sulfoamino group, a halogen atom, an alkoxycarbonyl group, a carbonyl group, an aryl group, an acyloxy group, an aralkyl group, an aryloxy group, an acryloyl group, an acyl group, an aminocarbonyl group or an alkoxy group; X represents an ether group, an ester group, an alkylene group, an arylene group, an alkylene carbonyloxy or arylenecarbonyloxy group, an amido group, a sulfonylamino group, an imino group, an alkyleneoxy group, or an aryleneoxy group; and A represents a non-metallic atom group necessary to form an aromatic group.

The monomer, from which a unit of the formulas (a) through (h) is derived, can be synthesized by reacting methacrylic acid, acrylic acid, glycidylmethacrylate, methacryl chloride, acryl chloride, methacryloyloxyethylisocyanate, vinyl phenol, maleic anhydride, maleic acid, meta-isopropenylbenzylisocyanate, crotyl chloride, vinyl chloroformate, or 2-hydroxyethyl(meth)acrylate, 4-hydroxybutyl(meth)acrylate with a compound having a phenolic hydroxy group or a compound having a primary amino group.

The polymer preferably has the amido group containing monomer unit and the phenolic hydroxy group containing monomer unit. The amido group containing monomer is preferably a methacrylamide monomer. The methacrylamide monomer unit content of the polymer is preferably 5 to 50 weight %, and more preferably 10 to 40 weight %. The phenolic hydroxy group containing monomer unit content of the polymer is preferably 10 to 80 weight %, and more preferably 20 to 60 weight %.

The polymer, having the amido group containing monomer unit and the phenolic hydroxy group containing monomer unit, may contain another monomer unit.

The polymer is preferably a copolymer having methacrylamide as the amido group containing monomer unit and at least one selected from hydroxyphenylmethacrylamide, N-hydroxyphenylmaleimide and vinyl phenol as the phenolic hydroxy group containing monomer unit.

It is preferable that the polymer has a weight average molecular weight (Mw) of $10^4$ to $10^7$. It is more preferable that the polymer is a mixture of two to five of a polymer having an amido group with a weight average molecular weight (Mw) of $10^4$ to $5\times10^4$ and two to five of a polymer having an amido group with a weight average molecular weight (Mw) of $10^5$ to $10^7$. It is still more preferable that the polymer is a mixture of two or three of a polymer having an amido group with a weight average molecular weight (Mw) of $10^4$ to $5\times10^4$ and two or three of a polymer having an amido group with a weight average molecular weight (Mw) of $10^5$ to $10^7$. The light sensitive composition of the invention contains the polymer in an amount of preferably 1 to 50 weight %, and more preferably 5 to 30 weight %.

The polymer described in items (1) through (3) is advantageous in excellent developability and chemical resistance of light sensitive composition.

(4) Polymer described in item (4) above

The polymer used in the light sensitive composition of the invention is preferably a polymer having an acid value of 5 or less. The term, "acid value" herein referred to implies an amount (mg) of potassium hydroxide (KOH) necessary to neutralize a free acid contained in 1 g of polymer. The examples thereof include polyamide, polyether, polyester, polycarbonate, polystyrene, polyurethane, polyvinyl chloride or its copolymer, a vinyl butyral resin, a vinyl formal resin, a shellac resin, an epoxy resin, a phenol resin, an acryl resin, and a water insoluble and dispersion resin (see Japanese Patent O.P.I. Publication No. 8-202048), each having an acid value (mg KOH/g) of 5 or less. In the invention, a vinyl type copolymer and an acryl resin are preferably used, and another polymer may be used in combination. The example of the polymer having an acid value (mg KOH/g) of 5 or less includes an acryl resin having a carboxy group containing monomer unit such as acrylic acid, methacrylic acid, maleic acid or itaconic acid. This polymer is advantageous in excellent storage stability of light sensitive composition or of presensitized printing plate having a light sensitive layer comprising the light sensitive composition on a support.

The polymer has a weight average molecular weight (Mw) of preferably $5\times10^3$ to $8\times10^4$, and more preferably $5\times10^3$ to $5\times10^4$. The light sensitive composition of the invention contains the polymer in an amount of preferably 5 to 80 weight %, and more preferably 10 to 60 weight %.

(5) Polymer described in item (5) above (5) The polymer used in the light sensitive composition of the invention includes a polymer having an amino group. The examples thereof include polyamide, polyether, polyester, polycarbonate, polystyrene, polyurethane, polyvinyl chloride or its copolymer, a vinyl butyral resin, a vinyl formal resin, a shellac resin, an epoxy resin, a phenol resin, an acryl resin, and a water insoluble and dispersion resin, each having an amino group. In the invention, a vinyl type copolymer and an acryl resin are preferably used, and another polymer may be used in combination. The example of a monomer having an amino group constituting the polymer includes m-aminosulfonylphenylmethacrylate, p-aminosulfonylphenylmethacrylate, m-aminosulfonylphenylacrylate, p-aminosulfonylphenylacrylate, N-(p-aminosulfonyl) methacrylamide, N-(p-aminosulfonyl)acrylamide, N-dimethylaminoethylacrylate, N-dimethylaminoethylmethacrylate, and N-dimethylaminopropylacrylamide.

The polymer has a weight average molecular weight (Mw) of preferably $5\times10^3$ to $8\times10^4$, and more preferably $5\times10^3$ to $5\times10^4$. The light sensitive composition of the invention contains the polymer in an amount of preferably 5 to 80 weight %, and more preferably 10 to 60 weight %

The polymer described in items (4) and (5) is advantageous in excellent storage stability of providing light sensitive composition with no sensitivity fluctuation after long-term storage.

The polymer described items (1) through (5) is a polymer used in the positive working light sensitive composition, but the same polymer as above can be also used in the negative working light sensitive composition of item (6).

Other components used in the light sensitive composition of the invention will be explained below. (A compound capable of generating an acid on irradiation of an active light)

The compound (hereinafter referred to as the acid generating compound in the invention) capable of generating an acid on irradiation of an active light used in the light sensitive composition of the invention includes various conventional compounds and mixtures. For example, a salt of diazonium, phosphonium, sulfonium or iodonium ion with $BF_4^-$, $PF_6^-$, $SbF_6^-$ $SiF_6^{2-}$ or $ClO_4^-$, an organic halogen containing compound, o-quinonediazide sulfonylchloride or a mixture of an organic metal and an organic halogen containing compound is a compound capable of generating or releasing an acid on irradiation of an active light, and can be used as the acid generating compound in the invention. The organic halogen containing compound known as an photoinitiator capable of forming a free radical forms a hydrogen halide and can be used as the acid generating compound of the invention.

The examples of the organic halogen containing compound capable of forming a hydrogen halide include those disclosed in U.S. Pat. Nos. 3,515,552, 3,536,489 and 3,779,778 and West German Patent No. 2,243,621, and compounds generating an acid by photodegradation disclosed in West German Patent No. 2,610,842. The examples of the acid generating compounds used in the invention include o-naphthoquinone diazide-4-sulfonylhalogenides disclosed in Japanese Patent O.P.I. Publication No. 50-30209.

The preferable acid generating compound in the invention is an organic halogen containing compound in view of sensitivity to infrared rays and storage stability of an image forming material using it. The organic halogen containing compound is preferably a halogenated alkyl-containing triazines or a halogenated alkyl-containing oxadiazoles. Of these, halogenated alkyl-containing s-triazines are especially preferable. The examples of the halogenated alkyl-containing oxadiazoles include a 2-halomethyl-1,3,4-oxadiazole compound disclosed in Japanese Patent O.P.I. Publication Nos. 54-74728, 55-24113, 55-77742/1980, 60-3626 and 60-138539. The preferable examples of the 2-halomethyl-1,3,4-oxadiazole compound are listed below.

A

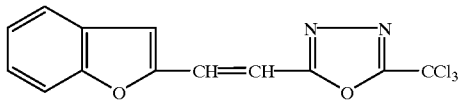

B

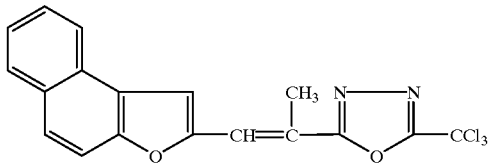

C

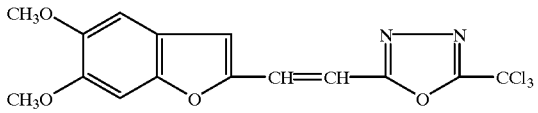

The halogenated alkyl containing triazines are preferably a compound represented by the following formula formula (1)

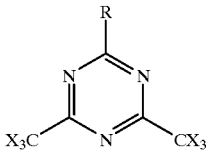

wherein R represents an alkyl group, a halogenated alkyl, a styryl group which may have an alkoxy group, or an aryl group (for example, phenyl or naphthyl group) which may have an alkoxy group, or its substituent; and $X_3$ represents a halogen atom.

The examples of an s-triazine acid generating compound represented by formula (1) are listed below.

(1)

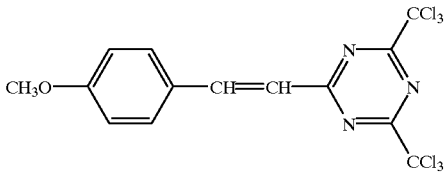

(2)

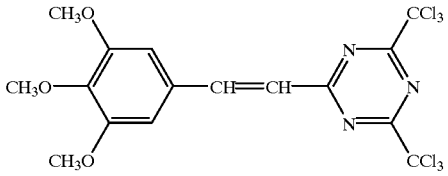

-continued (3)

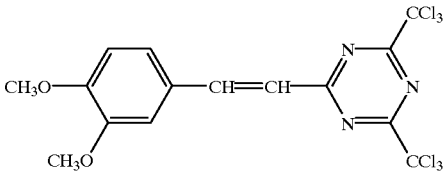

(4)

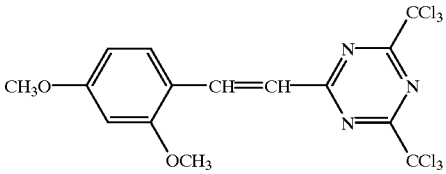

(5)

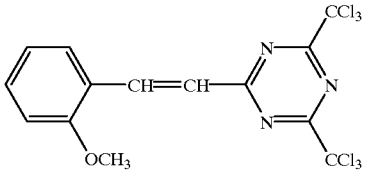

(6)

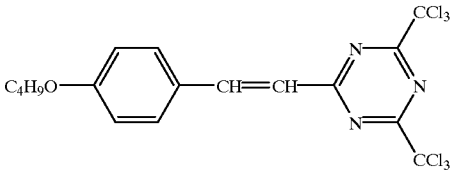

(7)

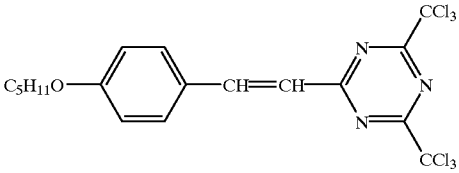

(8)

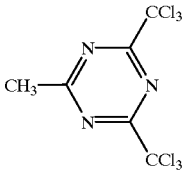

(9)

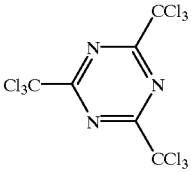

(10)

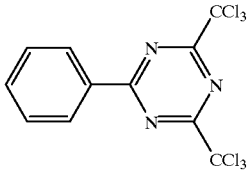

-continued (11)

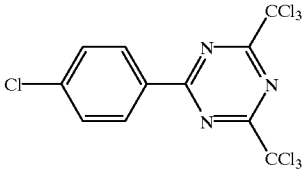

(12)

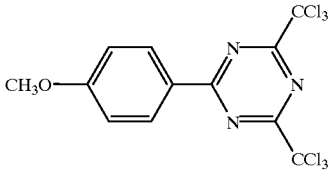

(13)

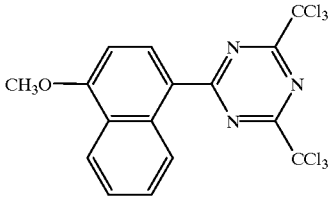

(14)

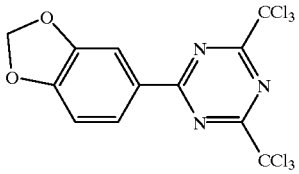

The content of the acid generating compound in the light sensitive composition is preferably 0.1 to 20% by weight, and more preferably 0.2 to 10% by weight based on the total weight of the solid components of the composition or a dry light sensitive layer prepared from the composition, although the content braodly varies depending on its chemical properties, kinds of light sensitive composition used or physical properties of the composition.

(Compound Having a Chemical Bond Capable of Being Decomposed by an Acid)

The compound (hereinafter referred to also as the acid decomposable compound in the invention) having a chemical bond capable of being decomposed by an acid used in the invention includes a compound having a C—O—C bond disclosed in Japanese Patent O.P.I. Publication Nos. 48-89003/1973, 51-120714/1976, 53-133429/1978, 55-12995/1980, 55-126236/1980 and 56-17345/1981, a compound having a Si—O—C bond disclosed in Japanese Patent O.P.I. Publication Nos. 60-37549/1985 and 60-121446/1985, another acid decomposable compound disclosed in Japanese Patent O.P.I. Publication Nos. 60-3625/1985 and 60-10247/1985, a compound having a Si—N bond disclosed in Japanese Patent O.P.I. Publication No. 62-222246/1987, a carbonic acid ester disclosed in Japanese Patent O.P.I. Publication No. 62-251743/1987, an orthocarbonic acid ester disclosed in Japanese Patent O.P.I. Publication No. 62-2094561/1987, an orthotitanic acid ester disclosed in Japanese Patent O.P.I. Publication No. 62-280841/1987, an orthosilicic acid ester disclosed in Japanese Patent O.P.I. Publication No. 62-280842/1987, an acetal or ketal disclosed in Japanese Patent O.P.I. Publication No. 63-10153/1988 and a compound having a C—S bond disclosed in Japanese Patent O.P.I. Publication No. 62-244038/1987.

Of these compounds, the compound having a C—O—C bond, the compound having a Si—O—C bond, the orthocarbonic acid ester, the acetals or ketals or the silylethers disclosed in Japanese Patent O.P.I. Publication Nos. 53-133429/1978, 56-17345/1981, 60-121446/1985, 60-37549/1985, 62-209451/1987 and 63-10153/1988 are preferable. Of these compounds is especially preferable a polymer disclosed in Japanese Patent O.P.I. Publication No. 53-133429/1978 which has a repeated acetal or ketal group in the main chain and increasing solubility in a developer by action of an acid or a compound capable of being decomposed by an acid disclosed in Japanese Patent O.P.I. Publication No. 63-10153/1988, which has the following structure:

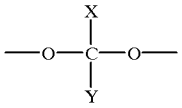

Wherein X represents a hydrogen atom or

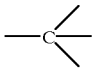

Y represents

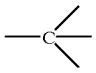

provided that X and Y may be the same or different.

The examples of the acid decomposable compound used in the invention include compounds disclosed in the above described patent specifications and their synthetic method is described in the above described patent specifications.

As the acid decomposable compound in the invention, a compound having a $—(CH_2CH_2O)_n—$group in which n is an integer of 1 to 5, in view of sensitivity and developability. Of the compound having a $—(CH_2CH_2O)_n—$group, n is especially preferably 1 to 4. The typical example of such a compound includes a condensation product of dimethoxycyclohexane, benzaldehyde or their derivative with diethylene glycol, triethylene glycol, tetraethylene glycol or pentaethylene glycol.

In the invention, the compound represented by the following formula (2) is preferable as the acid decomposable compound in view of sensitivity and developability.

wherein R, $R_1$ and $R_2$ independently represent a hydrogen atom, an alkyl group having 1 to 5 carbon atoms, an alkoxy group having 1 to 5 carbon atoms, a sulfo group, a carboxyl group or a hydroxy group, p, q and r independently represent an integer of 1 to 3, and m and n independently represent an integer of 1 to 5. The alkyl group represented by R, $R_1$ and $R_2$ may be straight chained or branched, and includes a methyl group, an ethyl group, a propyl group, an isopropyl group, a butyl group, a tert-butyl group, and a pentyl group. The alkoxy group represented by R, $R_1$ and $R_2$ includes a methoxy group, an ethoxy group, a propoxy group, an isopropoxy group, a butoxy group, a tert-butoxy group, and a pentoxy group. In the compound represented by formula (2), m and n each especially preferably are 1 to 4. The compound represented by formula (2) can be prepared according to a conventional synthetic method.

The content of the acid decomposable compound in the invention is preferably 5 to 70% by weight, and more preferably 10 to 50% by weight based on the total solid weight of the light sensitive composition or the layer containing the light sensitive composition. The acid decomposable compound in the invention can be used singly or in combination.

(Infrared Absorber)

The infrared absorber used in the invention includes an infrared absorbing dye having an absorption in the wavelength range of 700 nm or more, carbon black and magnetic powder. The especially preferable infrared absorber has an absorption maximum in the wavelength range of 700 nm to 850 nm and having a molar extinction coefficient, $\epsilon$ of $10^5$ or more.

The above infrared absorber includes cyanine dyes, squarylium dyes, chloconium dyes, azulenium dyes, phthalocyanine dyes, naphthalocyanine dyes, polymethine dyes, naphthoquinone dyes, thiopyrilium dyes, dithiol metal complex dyes, anthraquinone dyes, indoaniline metal complex dyes and intermolecular charge transfer complex dyes. The above described infrared absorber includes compounds disclosed in Japanese Patent O.P.I. Publication Nos. 63-139191/1988, 64-33547/1989, 1-160683/1989, 1-280750/1989, 1-293342/1989, 2-2074/1990, 3-26593/1991, 3-30991/1991, 3-34891/1991, 3-36093/1991, 3-36094/1991, 3-36095/1991, 3-42281/1991 and 3-103476/1991.

In the invention, the infrared absorber is especially preferably a cyanine dye represented by the following formula (3) or (4):

formula (2)

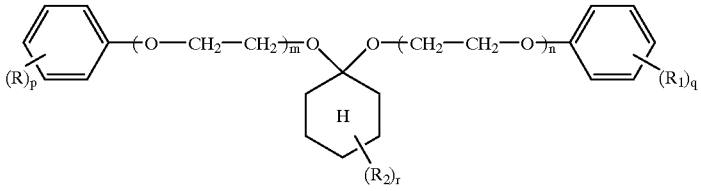

formula (3)

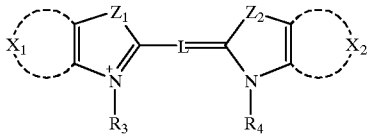

formula (4)

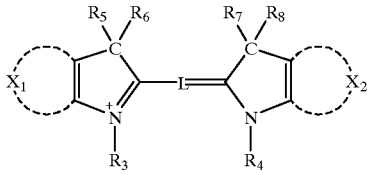

wherein $Z_1$ and $Z_2$ independently represent a sulfur atom, a selenium atom or an oxygen atom; $X_1$ and $X_2$ independently represent a non-metallic atomic group necessary to form a benzene or naphthalene ring, which may have a substituent; $R_3$ and $R_4$ independently represent a substituent, provided that one of $R_3$ and $R_4$ represents an anionic group, $R_5$, $R_6$, $R_7$ and $R_8$ independently represent a hydrogen atom, a halogen atom or an alkyl group having 1 to 3 carbon atoms; and L represents a linkage with a conjugated bond having 5 to 13 carbon atoms.

The cyanine dye represented by formula (3) or (4) includes a cyanine dye in which formula (3) or (4) itself forms a cation in its intramolecule and has an anionic group as a counter ion. T he anionic group includes $Cl^-$, $Br^-$, $ClO_4^-$, $BF_4^-$, and an alkyl borate anion such as a t-butyltriphenyl borate anion.

The carbon number (n) in the linkage with a conjugated bond represented by L of formula (3) or (4) is preferably selected to match with wavelength of light emitted from an infrared laser used for exposure as a light source. For example, when a YAG laser, which emits 1060 nm light, is used, n is preferably 9 to 13. The conjugated bond may have a substituent, and may form a ring together with another atomic group. The substituent of the ring represented by $X_1$ or $X_2$ may be any, but is preferably a group selected from the group consisting of a halogen atom, an alkyl group having 1 to 5 carbon atoms, an alkoxy group having 1 to 5 carbon atoms, —$SO_3M$, and —COOM (in which M represents a hydrogen atom or an alkali metal atom). The substituent of $R_3$and $R_4$ may be any, but is preferably an alkyl group having 1 to 5 carbon atoms, an alkoxy group having 1 to 5 carbon atoms, or —$((CH_2)_n—O—)_k—(CH_2)_mOR$ (in which n and m independently represent an integer of 1 to 3, k represents 0 or 1, and R represents an alkyl group having 1 to 5 carbon atoms), or preferably one of $R_3$ and $R_4$ represents —$RSO_3M$, and the other —$RSO_3^-$, in which R represents an alkylene group having 1 to 5 carbon atoms, and M represents an alkali metal atom, or preferably one of $R_3$ and $R_4$ represents —RCOOM, and the other —$RCOO^-$, in which R represents an alkylene group having 1 to 5 carbon atoms, and M represents an alkali metal atom. It is more preferable in view of sensitivity or developability that one of $R_3$ and $R_4$ represents —$RSO_3M$ or —RCOOM, and the other —$RSO_3^-$ or —$RCOO^-$.

When a semiconductor laser is used for exposure as a light source, a dye represented by formula (3) or (4) is preferably a dye having an absorption peak in the range of 750 to 900 nm and a molar extinction coefficient $\epsilon$ exceeding $1\times10^5$, and when a YAG laser is used for exposure as a light source, a dye represented by formula (3) or (4) is preferably a dye having an absorption peak in the range of 900 to 1200 nm and a molar extinction coefficient $\epsilon$ exceeding $1\times10^5$.

The examples of the infrared absorber preferably used in the invention are listed below, but are not limited thereto.

IR1

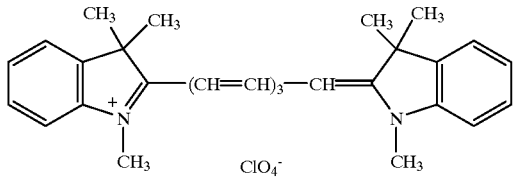

IR2

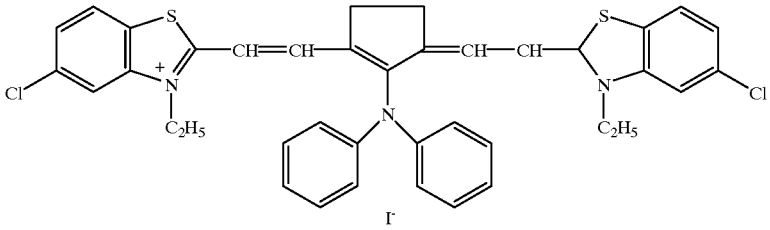

IR3

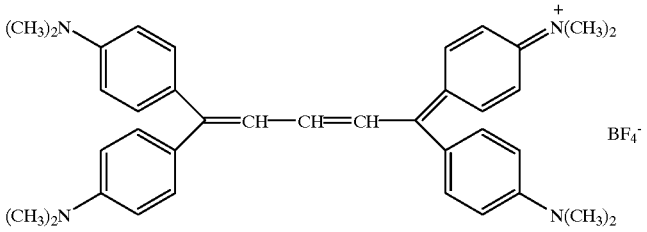

-continued
IR4
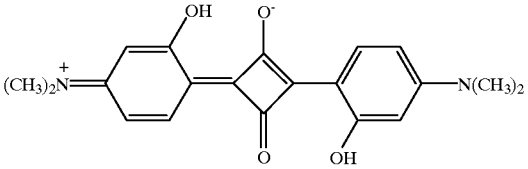
IR5
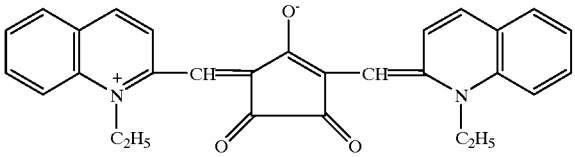
IR6
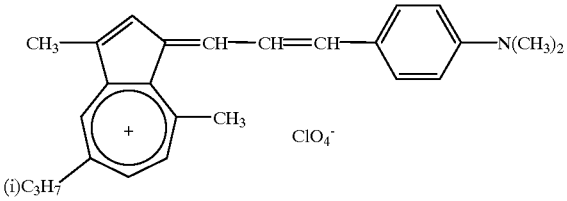
IR7
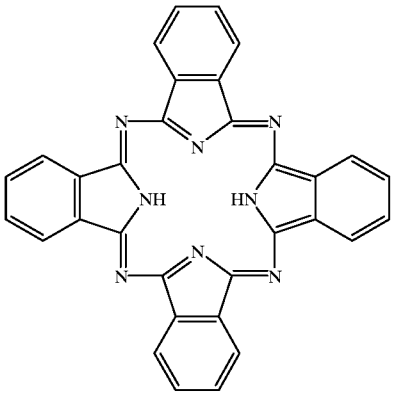
IR8
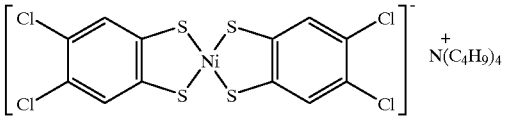
IR9
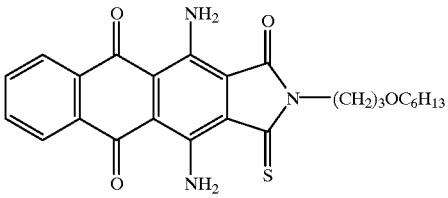
IR10
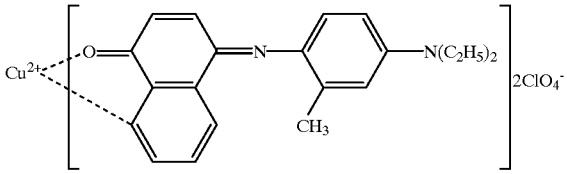

-continued
IR11
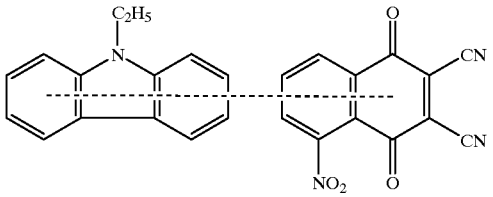
IR12
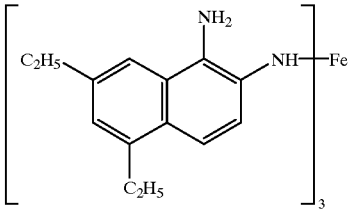
IR13
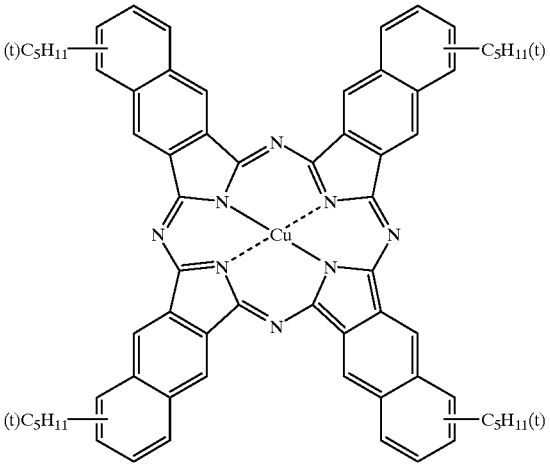
IR14
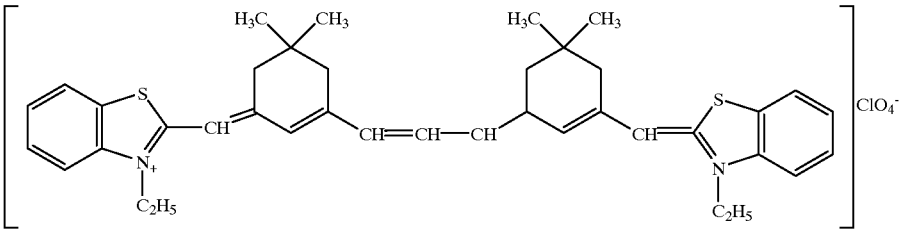
IR15
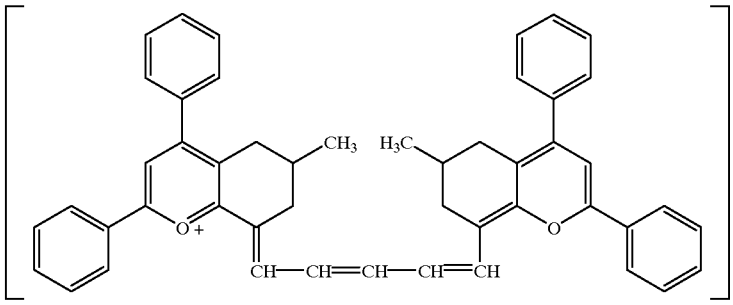

-continued
IR16
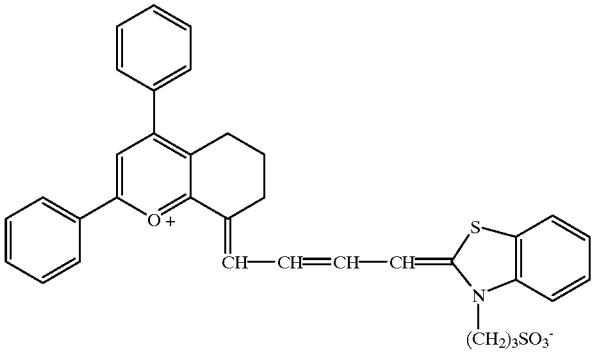
IR17
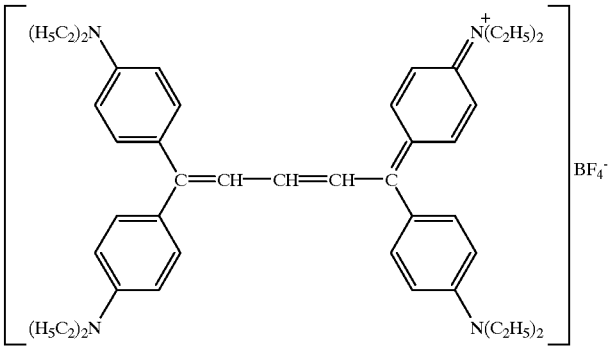
IR18
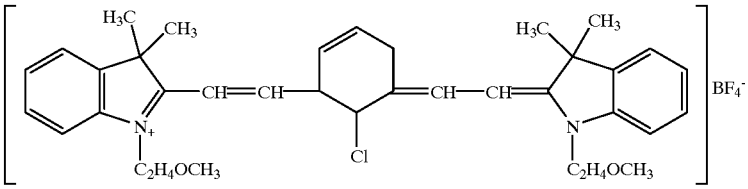
IR19
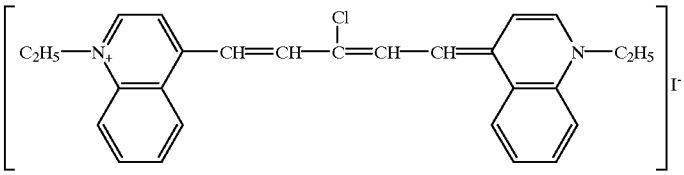
IR20
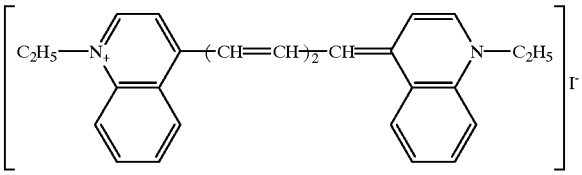
IR21
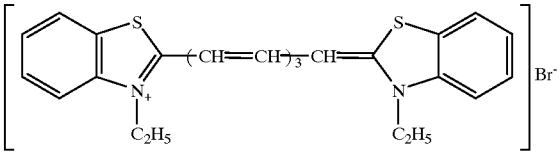

-continued
IR22
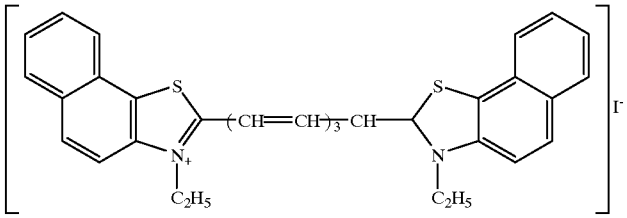
IR23
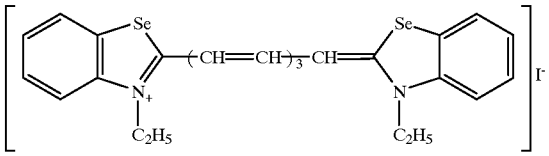
IR24
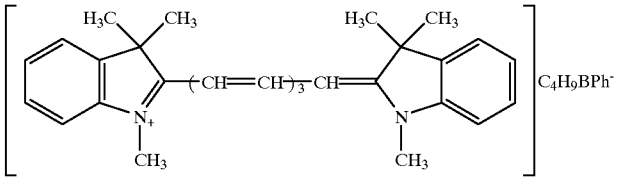
IR25
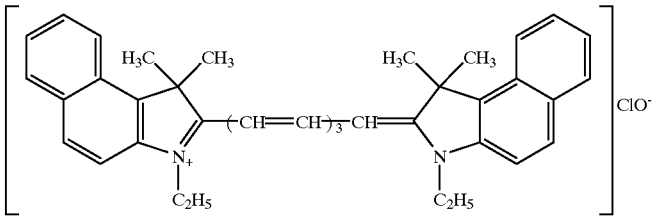
IR26
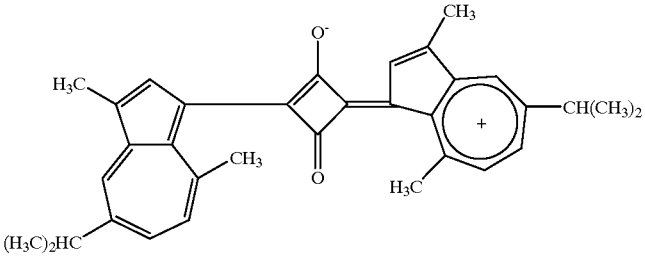
IR27
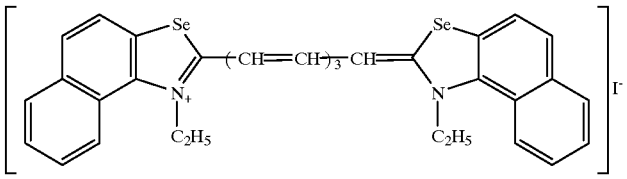
IR28
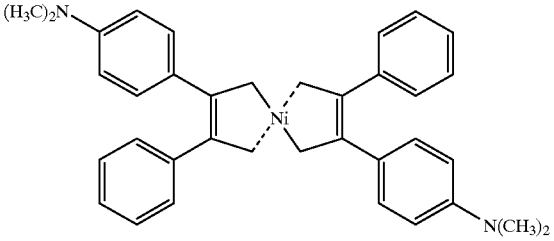

-continued
IR29
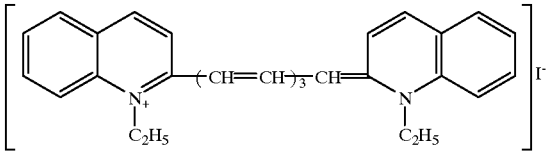
IR30
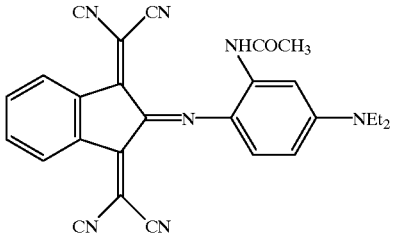
IR31
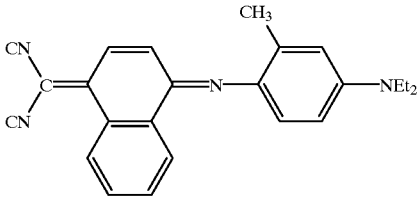
IR32
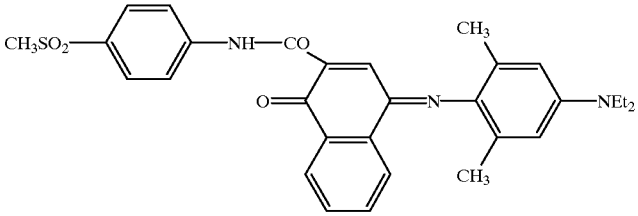
IR33
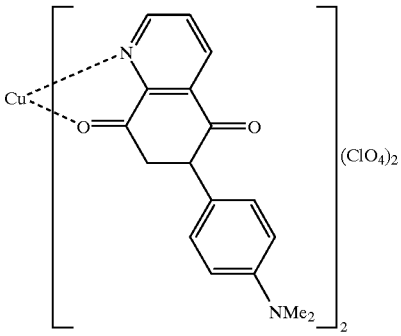
IR34
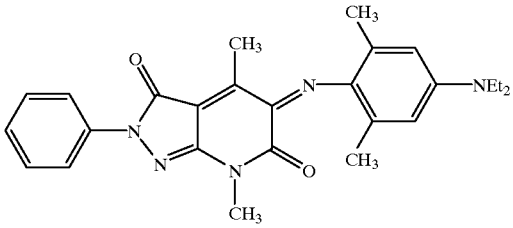

-continued
IR35
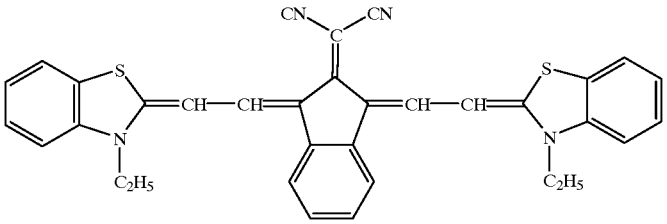
IR36
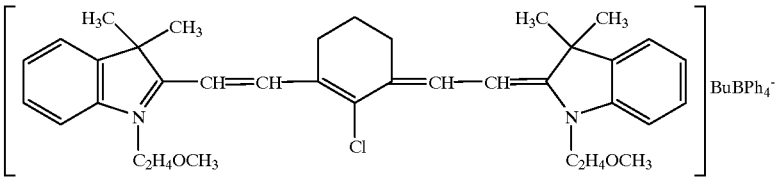
IR37
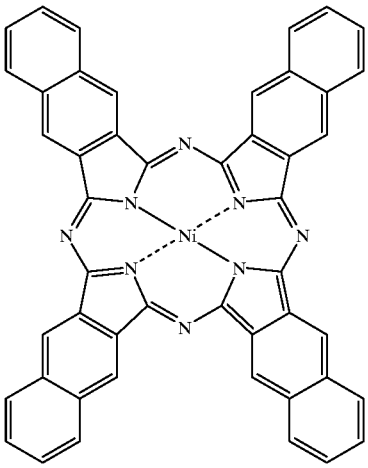
IR38
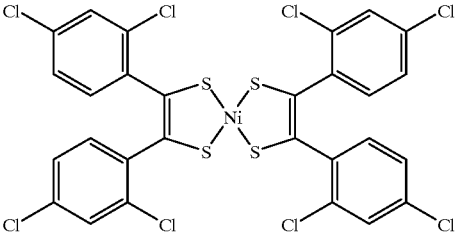
IR39
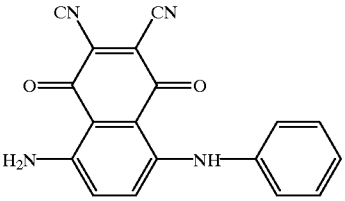
IR40
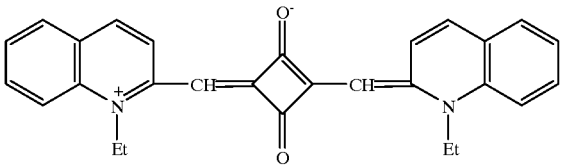

-continued
IR41
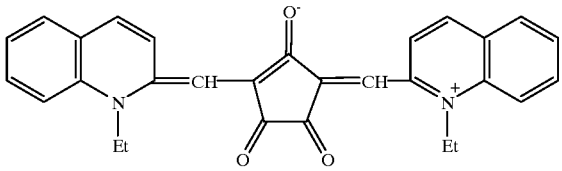
IR42
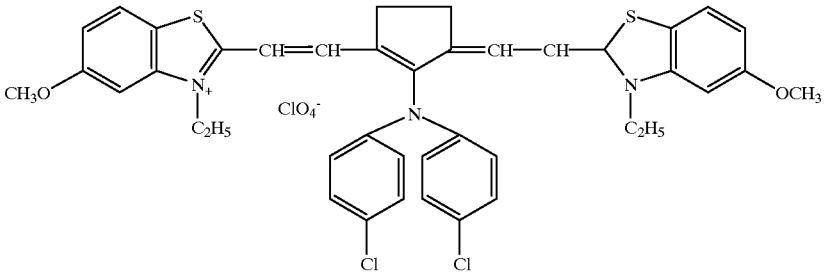
IR43
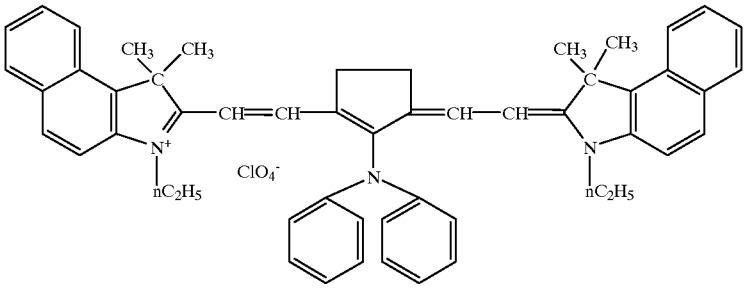
IR44
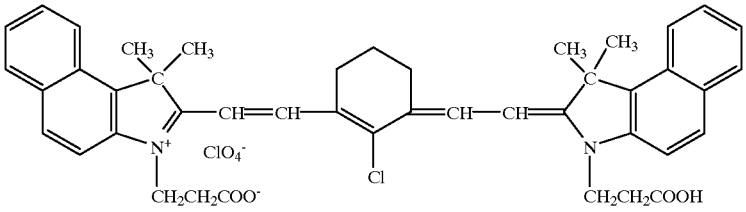
IR45
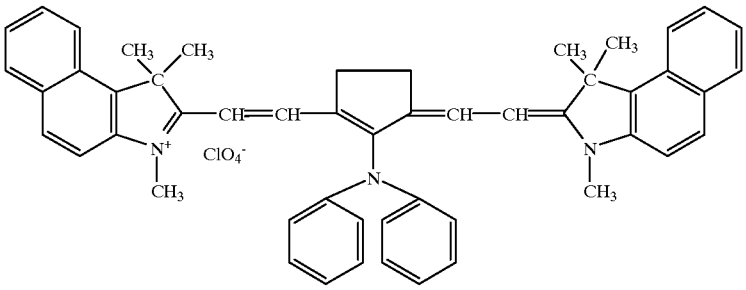
IR46
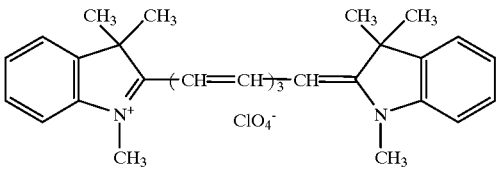

-continued
IR47
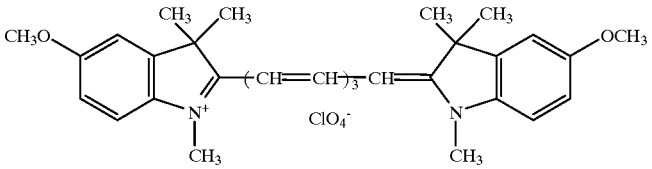
IR48
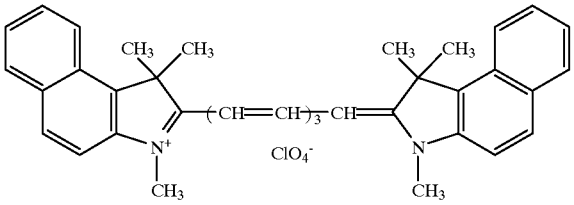
IR49
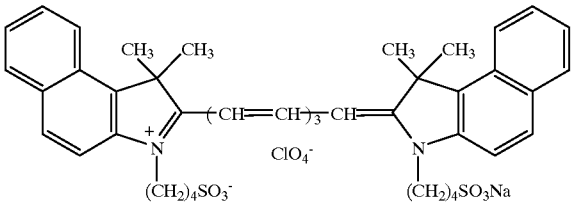
IR50
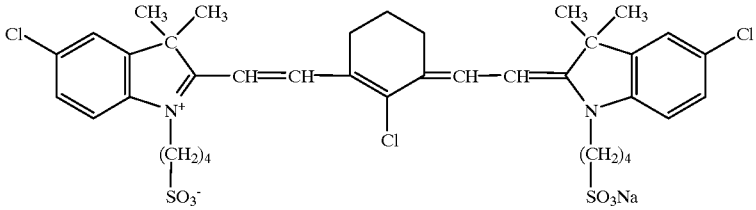
IR51
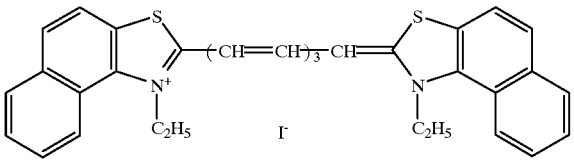
IR52
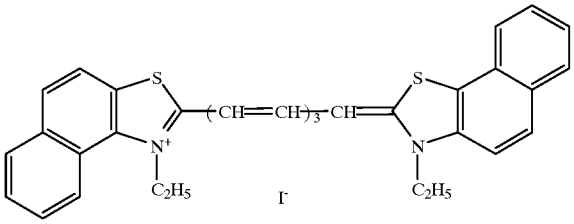
IR53
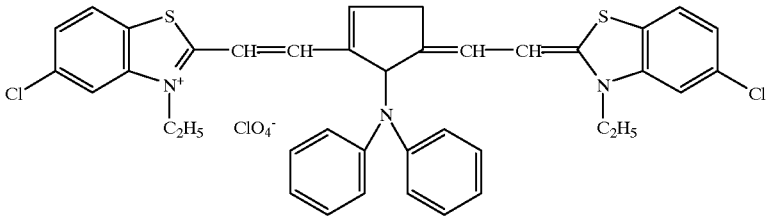

-continued

IR54

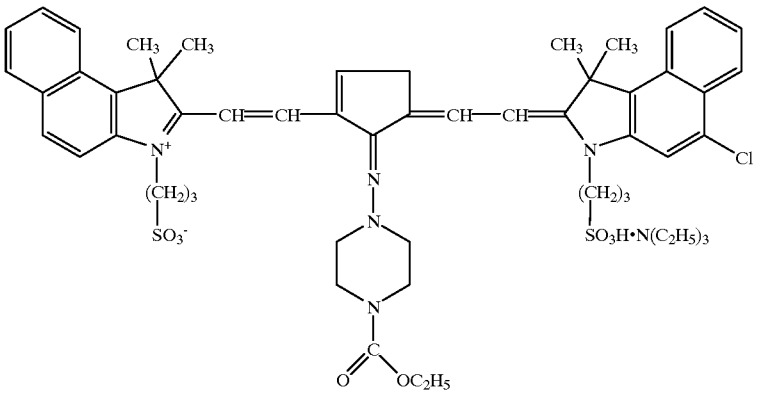

IR55

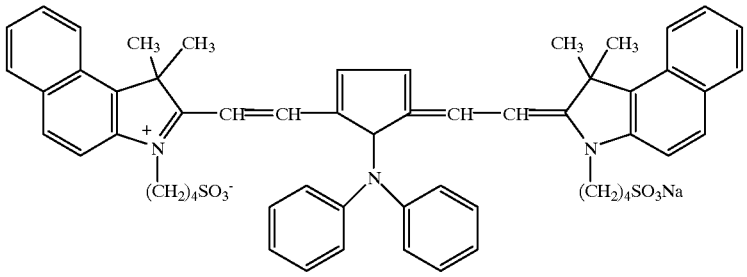

These dyes can be obtained by a conventional synthetic method, and the following commercially available dyes can be used:

IR750 (antraquinone type); IR002 and IR003 (aluminum type), IR820 (polymethine type); IRG022 and IRG033 (diimmonium type); CY-2, CY-4, CY-9 and CY-20, each produced by Nihon Kayaku Co., Ltd.;

KIR103 and SIR103 (phthalocyanine type); KIR101 and SIR114 (antraquinone type); PA1001, PA1005, PA1006 and SIR128, (metal complex type), each produced by Mitsui Toatsu Co., Ltd.;

Fastogen Blue 8120 produced by Dainihon Ink Kagaku Co., Ltd.; and

MIR-101,1011, and 1021 each produced by Midori Kagaku Co., Ltd.

Other infrared dyes are sold by Nihon Kankoshikiso Co., Ltd., Sumitomo Kagaku Co., Ltd. or Fuji Film Co., Ltd.

In the invention, the content of the infrared absorber is preferably 0.5 to 5% by weight based on the total weight of solid components of the light sensitive composition.

(Compound Having a Group Cross-Linking by an Acid)

The compound having a group cross-linking by an acid used in item (6) will be explained below.

In the invention, the compound having a group cross-linking by an acid herein referred to is a compound (hereinafter referred to also as a cross-linking agent) cross-linking alkali soluble resins in the presence of an acid. The cross-linking agent cross-links the alkali soluble resin and lowers solubility in the alkali of the cross-linked alkali soluble resin. The alkali solubility lowering extent in the invention is such that the cross-linked alkali soluble resin is insoluble in the alkali. Concretely, when the light sensitive material is imagewise exposed which comprising a light sensitive layer containing the alkali soluble resin and the cross-linking agent on a support, the alkali soluble resin at exposed portions is cross-linked so that the cross-linked resin is insoluble in an alkali solution as a developer, in which the alkali soluble resin before exposure has been soluble in the developer, and the exposed material is developed with the developer to remain the exposed portions on the support. The cross-linking agent includes an amino compound having an alkoxymethyl group, a methylol group or an acetoxymethyl group such as a melamine derivative (hexamethoxymethylated melamine, Cymel 300 series (1), produced by Miteui Cyanamide Co. Ltd.), a benzoguanamine derivative (methyl-ethyl mixed alkylated benzoguanamine resin, Cymel 1100 series (2), produced by Miteui Cyanamide Co. Ltd.), a glycoluryl derivative (tetramethylolglycoluryl, Cymel 1100 series (3), produced by Miteui Cyanamide Co. Ltd.), and an aromatic compound having at least two substituents and having an alkoxymethyl group, a methylol group or an acetoxymethyl group as a functional group such as 1,3,5-triacetoxymethylbenzene, or 1,2,4,5-tetraacetoxymethylbenzene. These can be synthesized according to a method described in Polym. Master. Sci. Eng., 64, 241 (1991).

Besides the above, a resol resin or a furan resin can be used as a cross-linking agent. Further, an acryl resin synthesizsed from the following monomer can be also used. The monomer includes N-methylolacrylamide, N-methylolmethacrylamide, N,N'-dimethylolacrylamide, N,N'-dimethylolmethacrylamide, N-(2-hydroxyethyl) acrylamide, N-(2-hydroxyethyl)methacrylamide, N,N-di(2-hydroxyethyl)acrylamide, N,N-di(2-hydroxyethyl) methacrylamide, N-hydroxymethyl-N-(2-hydroxyethyl) acrylamide, N-hydroxymethyl-N-(2-hydroxyethyl) methacrylamide, hydroxyethylvinyl ether, vinylbenzyl alcohol, α-methylvinylbenzylacetate, vinylphenetyl alcohol, and α-methylvinylphenetylacetate. This acryl resin contains these monomers in an amount of 1 to 50 mol %, and preferably 5 to 30 mol %.

The cross-linking agent includes those described in Japanese Patent O.P.I. Publication Nos. 3-185449, 5-210239, 7-146556, 7-104473, 7-36187, 6-282072, 6-266105, 6-214391, 6-214392, 6-123968, 5-249662, 6-194838, 5-232707 and 6-138660.

The content of the cross-linking agent is preferably 5 to 60% by weight, and more preferably 20 to 45% by weight based on the total solid weight of light sensitive composition. The croslinking agent may be used singly or in combination of two or more kinds.

(Binder)

The light sensitive composition optionally contains another binder other than the above described polymers. A polymer binder can be used as the binder. The polymer binder includes a novolak resin, a polyhydroxystyrene, a polymer containing a structural unit represented by formula (5) described later, and another conventional acryl resin.

The novolak resin includes a phenol.formaldehyde resin, a cresol.formaldehyde resin, a phenol.cresol.formaldehyde resin disclosed in Japanese Patent O.P.I. Publication No. 55-57841/1980 and a polycondensation resin of a p-substituted phenol or phenol and cresol with formaldehyde.

The polyhydroxystyrene includes a homopolymer or copolymer of hydroxystyrene disclosed in Japanese Patent Publication No. 52-41050/1977.

The polymer containing a structural unit represented by formula (5) includes a homopolymer containing only the structural unit represented by formula (5) and a copolymer containing the structural unit represented by formula (5) and a monomer unit formed by cleavage of a polymerizable double bond of another vinyl monomer.

formula (5)

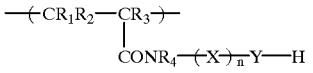

wherein $R_1$ and $R_2$ independently represent a hydrogen atom, an alkyl group such as methyl or ethyl or a carboxyl group, and preferably a hydrogen atom; $R_3$ represents a hydrogen atom, a halogen atom such as chlorine or bromine or an alkyl group such as methyl or ethyl, and preferably a hydrogen atom or methyl; $R_4$ represents a hydrogen atom, an alkyl group such as methyl, an aryl group such as a phenyl group or a naphthyl group; Y represents a substituted or unsubstituted phenylene or naphthylene group, the substituent including an alkyl group such as methyl or ethyl, a halogen atom such as chlorine or bromine; a carboxyl group, an alkoxy group such as methoxy or ethoxy, a hydroxy group, a sulfonic acid group, a cyano group, a nitro group or an acyl group, and preferably a unsubstituted phenylene or naphthylene group or a methyl substituted phenylene or naphthylene group; X represents an organic divalent linkage group; and n is an integer of 0 to 5, and n is preferably 0.

The polymer having a structural unit represented by formula (5) includes polymers represented by the following formulas (a) through (f):

formula (5)

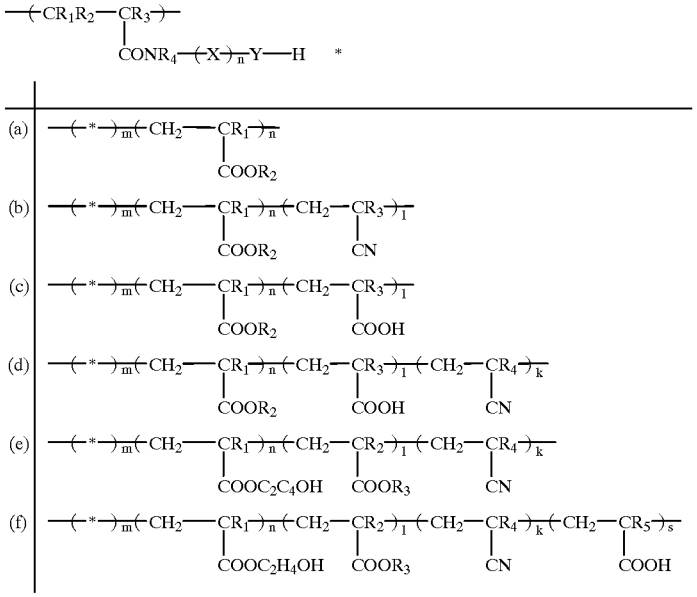

In formulas (a) through (f), $R_1$ through $R_5$ independently represent a hydrogen atom, an alkyl group or a halogen atom; and m, n, l, k and s independently represent mol %.

The preferable embodiments in the invention include those further comprising the novolak resin, the polymer having a monomer unit from formula (5) or other acryl resins. The acryl resin includes a polymer having a monomer unit from acrylic acid, methacrylic acid or their ester. The novolak resin content is preferably 20 to 80% by weight based on the solid components of the light sensitive composition of the invention. The content of the polymer having a monomer unit from formula (5) or other acryl resins is preferably 1 to 50% by weight, and more preferably 5 to 30% by weight, based on the solid components of the light sensitive composition of the invention.

Another preferable embodiment in the invention include those comprising the novolak resin and a nonionic surfactant. The nonionic surfactant includes polyoxyethylene alkylether, polyoxyethylene alkylarylether, polyoxyethylene derivatives, oxyethylene-oxypropylene block polymer, sorbitan fatty acid ester, polyoxyethylene sorbitan fatty acid ester, polyoxyethylene sorbitol fatty acid ester, glycerin fatty acid ester, polyoxyethylene fatty acid ester, polyoxyethylene alkylamine, alkylalkanol amide, and polyethylene glycol. In this case, the novolak resin content is preferably 20 to 80% by weight based on the solid components of the light sensitive composition used, and the nonionic surfactant content is preferably 0.01 to 10% by weight, and more preferably 0.1 to 1.0% by weight, based on the solid components of the light sensitive composition used.

From the viewpoint of preventing occurrence of stains on non-image area in course of time, it is preferable that the light sensitive composition contains a fluorine-containing surfactant in an amount of 0.001 to 5 wt %.

As the fluorine-containing surfactant, the following compounds, for example, are given.

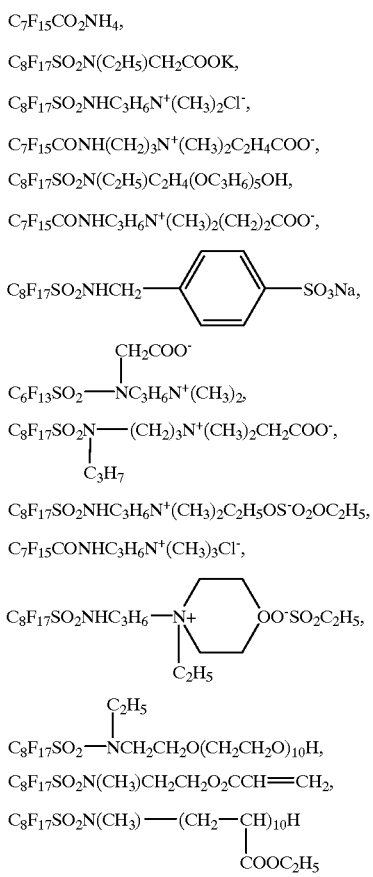

With regard to the fluorine-containing surfactant, it is also possible to use those available on the market, and examples of them include, Surfron "S-381", "S-382", "SC-101", "SC-102", "SC-103", "SC-104" (each made by Asahi Glass Co.), Fluorad "FC-430" "FC-431", "FC-173" (each made by Fluorochemical-Sumitomo 3M Co.), Eftop "EF 352", "EF 301", "EF 303" (each made by Shin-Akita Kasei Co.), Schwegolfer "8035", "8036" (each made by Schwegman Co.), "BM1000", "BM1100" (each made by B.M. Hymie Co.), and Megafac "F-171", Megafac "F-177" (each made by Dainihon Ink Kagaku Co.).

The fluorine-containing surfactant content of the light sensitive composition in the invention is preferably 0.05 to 2 wt %, and more preferably 0.1 to 1 wt %, based on the solid components of the light sensitive composition used. The fluorine-containing surfactant can be used either independently or in combination of two or more kinds thereof.

The light sensitive layer of the image forming material of the invention may contain a lipophilic resin to increase lipophilicity of the layer. The lipophilic resin includes a polycondensate of phenols with an alkyl group having 3 to 15 carbon atoms with aldehydes, for example, a t-butylphenol.formaldehyde resin disclosed in Japanese Patent O.P.I. Publication No. 50-125806/1975.

As another polymer used, a conventional polymer can be employed in combination. The polymer used in combination includes polyamide, polyester, polycarbonate, polystyrene, polyurethane, polyvinyl chloride or their copolymer, a polyvinyl acetal, polyvinylbutyral, polyvinylformal, shellac, and an epoxy phenol, acryl or alkyd resin.

Among these polymers is preferable a copolymer obtained by copolymerizing a mixture of the following monomers (1) through (12).

(1) A monomer having an aromatic hydroxy group, for example, o-hydroxystyrene, p-hydroxystyrene, m-hydroxystyrene, o-hydroxyphenylacrylate, p-hydroxyphenylacrylate, m-hydroxyphenylacrylate, (2) A monomer having an aliphatic hydroxy group, for example, 2-hydroxyethylacrylate, 2-hydroxyethylmethacrylate, N-methylolacrylamide, N-methylolmethacrylamide, 4-hydroxybutylacrylate, 4-hydroxybutylmethacrylate, 5-hydroxypentylacrylate, 5-hydroxypentylmethacrylate, 6-hydroxyhexylacrylate, 6-hydroxyhexylmethacrylate, N-(2-hydroxyethyl) acrylamide, N-(2-hydroxyethyl)methacrylamide, hydroxyethylvinyl ether, (3) An α,β-unsaturated carboxylic acid, for example, acrylic acid, methacrylic acid, maleic acid, maleic anhydride, itaconic acid, itaconic anhydride, N-(p-toluenesulfonyl)acrylamide, N-(p-toluenesulfonyl)-methacrylamide, (4) A substituted or unsubstituted alkylacylate, for example, methylacrylate, ethylacrylate, propylacrylate, butylacrylate, amylacrylate, hexylacrylate, heptylacrylate, octylacrylate, nonylacrylate, decylacrylate, undecylacrylate, dodecylacrylate, benzylacrylate, cyclohexylacrylate, 2-chloroethylacrylate, N,N-dimethylaminoethylacrylate, glycidylacrylate, (5) A substituted or unsubstituted alkylmethacylate, for example, methylmethacrylate, ethylmethacrylate, propylmethacrylate, butylmethacrylate, amylmethacrylate, hexylmethacrylate, heptylmethacrylate, octylmethacrylate, nonylmethacrylate, decylmethacrylate, undecylmethacrylate, dodecylmethacrylate, benzylmethacrylate, cyclohexylmethacrylate, 2-chloroethylmethacrylate, N, N-dimethylaminoethylmethacrylate, glycidylmethacrylate, methacrylamide, (6) A monomer having a fluorinated alkyl group, for example, trifluoroethylacrylate, trifluoroethylmrthacrylate, tetrafluoropropylacrylate, tetrafluoropropylmethacrylate, hexafluoropropylmethacrylate, octafluoropentylacrylate, octafluoropentylmethacrylate, heptadecafluorodecylacrylate, heptadecafluorodecylmethacrylate, N-butyl-N-(2-acryloxyethyl)heptadecafluorooctylsulfonamide, (7) A vinyl ether, for example, ethylvinyl ether, 2-chloroethylvinyl ether, propylvinyl ether, butylvinyl ether, octylvinyl ether, phenylvinyl ether, (8) A vinyl ester, for example, vinyl acetate, vinyl chroloacetate, vinyl butate, vinyl benzoate, (9) A styrene, for example, styrene, methylstyrene, chloromethystyrene,

(10) A vinyl ketone, for example, methylvinyl ketone, ethylvinyl ketone, propylvinyl ketone, phenylvinyl ketone,

(11) An olefin, for example, ethylene, propylene, isobutylene, butadiene, isoprene,

(12) N-vinylpyrrolidone, N-vinylcarbazole, N-vinylpyridine,

The light sensitive layer in the image forming material of the invention may optionally contain dyes other than the dyes described above, pigment, sensitizers, visualizing agents or a UV absorbent.

(Dye)

The dye explained below is used for obtain a visible image after exposure (exposure visible image) or after development.

The dye is preferably a dye varying its color on reaction with a free radical or an acid. The term "varying its color" includes changing colorless to color, color to colorless or changing its color. The preferable dye is a dye varying its color by forming a salt with an acid.

The examples of the dyes changing its color to colorless or changing its color include a triphenylmethane dye such as Victoria Pure Blue BOH (produced by Hodogaya Kagaku Co. Ltd.), Oil Blue #603 (produced by Orient Kagaku Co. Ltd.), Patent Pure Blue (produced by Sumitomomikuni Kagaku Co. Ltd.), Crystal Violet, Brilliant green, Ethyl Violet, Methyl Violet, Methyl Green, Erythrosine B, Basic Fuchsin, Malachite Green, Oil red, m-Cresol Purple, Rhodamine B, Auramine, 4-p-diethylaminophenyliminonaphthoquinone or cyano-p-diethylaminophenyl-acetoanilide or a diphenylmethane, oxazine, xanthene, iminonaphthoquinone, azomethine or anthraquinone dye.

The examples of the dyes changing from colorless to color include a leuco dye or a primary or secondary amine such as triphenylamine, diphenylamine, o-chloroaniline, 1,2,3-triphenylguanidine naphthylamine, diaminodiphenylmethane, p,p'-bis-dimethylaminodiphenylamine, 1,2-dianilinoethylene, p,p',p"-tris-dimethylaminotriphenylmethane, p,p'-bis-dimethylaminodiphenylmethylimine, p,p',p"-triamino-o-methyltriphenylmethane or p,p'-bis-dimethylaminodiphenyl-4-anilinonaphthylmethane.

The dye added to a light sensitive composition may be a dye for only coloring the light sensitive composition. Such a dye includes an organic pigment such as phthalocyanine pigment, dioxazine pigment, zulene pigment, basic dye and the preferable pigment is phthalocyanine pigment or dioxazine pigment. In order to dipersing such pigment in the composition, the pigment is preferably added in admixture with a dispersing agent such as ε-caprolactone, a cationic surfactant, an anionic surfactant, a nonionic surfactant, a polyurethane resin, a vinyl resin or an unsaturated polyester (disclosed in "Saishin, Pigment Dispersion Technique" issued by Gijutsu Joho Kyokai Co., Ltd.).

The above dye content of the light sensitive composition is ordinarily 0.5 to 10 weight %, preferably about 1 to 7.5 weight % based on the total solid components.

(UV Absorbent)

The UV absorbent includes conventional UV absorbents such as those of salicylic acid, benzophenone, benzotriazole, or cyanoacrylate type. The UV absorbent content of the light sensitive composition is preferably 0.001 to 30 weight %, more preferably 0.0 1 to 20 weight % based on the total solid components.

(Basic Compound)

The light sensitive composition can contain a compound (hereinafter referred to as basic compound) capable of trapping proton. The basic compound are, for example, an amino compound, a Shiff base (a compound especially having =CN—) and acetic acid triphenyl phosphonium. The example thereof includes a basic nitrogen-containing compound described in Japanese Patent O.P.I. Publication No. 8-234030, an organic basic compound described in Japanese Patent O.P.I. Publication No. 9-54437, an amino compound or nitrogen-containing aromatic heterocyclic compound described in Japanese Patent O.P.I. Publication No. 8-22120, a thiosulfonate compound described in Japanese Patent O.P.I. Publication No. 8-211598, and a basic compound (a sulfonylhydrazide compound) to be neutralized after heating described in Japanese Patent O.P.I. Publication No. 7-219217. The light sensitive composition layer containing the basic compound to be neutralized after heating exhibits high sensitivity by being heated (post-baked) after exposure and before development. The basic compound can be used without any limitations, as long as it is a compound capable of trapping proton. The basic compounds may be singly or in combination of two or more kinds. The basic compound content of the light sensitive composition is preferably 0.001 to 10 weight %, more preferably 0.01 to 5 weight % based on the total solid components. The content of not more than 0.001 weight % does not show good storage stability or good small dot reproduction, and the content of not less than 10 weight % markedly decreases sensitivity.

(Solvent)

A solvent includes n-propanol, isopropyl alcohol, n-butanol, sec-butanol, isobutanol, 2-methyl-1-butanol, 3-methyl-1-butanol, 2-methyl-2-butanol, 2-ethyl-1-butanol, 1-pentanol, 2-pentanol, 3-pentanol, n-hexanol, 2-hexanol, cyclohexanol, methylcyclohexanol, 1-heptanol, 2-heptanol, 3-heptanol, 1-octanol, 4-methl-2-pentanol, 2-hexylalcohol, benzyl alcohol, ethylene glycol, diethylene glycol, triethylene glycol, tetraethylene glycol, 1,3-propane diol, 1,5-pentane glycol, dimethyl triglycol, furfuryl alcohol, hexylene glycol, hexyl ether, 3-methoxy-1-methylbutanol, butyl phenyl ether, ethylene glycol monoacetate, propylene glycol monomethylether, propylene glycol monoethylether, propylene glycol monopropylether, propylene glycol monobutylether, propylene glycol phenylether, dipropylene glycol monomethylether, dipropylene glycol monoethylether, dipropylene glycol monopropylether, dipropylene glycol monombutylether, tripropylene glycol monomethylether, methyl carbitol, ethyl carbitol, ethyl carbitol acetate, butyl carbitol, triethylene glycol monomethylether, triethylene glycol monoethylether, tetraethylene glycol dimethylether, diacetone alcohol, acetophenone, cyclohexanone, methyl cyclohexanone, acetonylacetone, isophorone, methyl lactate, ethyl lactate, butyl lactate, propylene carbonate, phenyl acetate, sec-butyl acetate, cyclohexyl acetate, diethyl oxalate, methyl benzoate, ethyl benzoate, γ-butyrolactone, 3-methoxy-1-butanol, 4-methoxy-1-butanol, 3-ethoxy-1-butanol, 3-methoxy-3-methyl-1-butanol, 3-methoxy-3-ethyl-1-pentanol, 4-ethoxy-1-pentanol, 5-methoxy-1-hexanol, 3-hydroxy-2-butanone, 4-hydroxy-2-butanone, 4-hydroxy-2-pentanone, 5-hydroxy-2-pentanone, 4-hydroxy-3-pentanone, 6-hydroxy-2-pentanone, 6-hydroxy-2-hexanone, 3-methyl-3-hydroxy-2-pentanone, methyl cellosolve (MC), and ethyl cellosolve (EC).

The solvent includes allyl alcohol, isopropyl ether, butyl ether, anisole, propylene glycol monomethylether acetate, diethyl carbitol, tetrahydro furane, dioxane, dioxolane, acetone, methylpropyl ketone, methylethyl ketone, methylamyl ketone, diethyl ketone, ethylbutyl ketone, dipropyl ketone, diisobutyl ketone, 2-methoxyethyl acetate, 2-ethoxyethyl acetate, methoxybutyl acetate, methyl propionate, propyl propionate, methyl butyrate, ethyl butyrate, butyl butyrate, N-methyl-2-pyrrolidone, acetonitrile, dimethylformamide (DMF), dimethylacetoamide (DMAc), n-pentane, 2-methylpentane, 3-ethylpentane, methylcyclopentane, n-hexane, isohexane, cyclohexane, methylcyclohexane, n-heptane, cycloheptane, n-octane, isooctane, nonane, decane, benzene, toluene, o-xylene, m-xylene, p-xylene, ethylbenzene, o-diethylbenzene, m-diethylbenzene, p-diethylbenzene, cumene, n-amylbenzene, dimethyl diglycol (DMDG), and ethanol.

[2] Image Forming Material

The image forming material of the invention comprises a support and provided thereon, a light sensitive layer containing the light sensitive composition described above. The image forming material is obtained by coating the light sensitive composition (the coating solution containing the solvent in the invention) on the support and drying to form a light sensitive layer.

The support, on which the light sensitive layer is provides, includes a metal plate such as aluminum, zinc, steel or copper, a metal plate, paper sheet, plastic film or glass plate which is plated or vacuum evaporated with chromium, zinc, copper, nickel, aluminum or iron, a paper sheet coated with a resin, a paper sheet laminated with a metal foil such as aluminum and a plastic film subjected to hydrophilic treatment.

When the invention is applied to a presensitized planographic printing plate, the support is preferably an aluminum plate which is subjected to a surface treatment such as graining treatment, anodizing treatment or sealing treatment. The surface treatment is carried out by a conventional method.

The graining treatment includes a mechanically graining method and an electrolytically etching method. The mechanically graining method includes a ball graining method, a brush graining method, a liquid horning graining method and a buff graining method. The above methods can be used singly or in combination according to an aluminum material composition. The electrolytically etching is carried out in a bath containing one or more of phosphoric acid, sulfuric acid, hydrochloric acid and nitric acid. After graining, the surface of the support is optionally subjected to desmut treatment using an alkaline or acid solution to neutralize and washed with water.

The anodizing is carried out by electrolyzing the surface of the aluminum support using the aluminum plate as an anode in a solution containing one or more of sulfuric acid, chromic acid, oxalic acid, phosphoric acid and malonic acid. The thickness of the anodizing film formed is suitably 1 to 50 mg/dm$^2$, preferably 10 to 40 mg/dm$^2$, and more preferably 25 to 40 mg/dm$^2$. The thickness of the anodizing film is obtained by immersing the anodized aluminum in a solution containing phosphoric acid and chromic acid (water is added to 35 ml of 85% phosphoric acid and 20 g of chromium (IV) oxide to make a 1 liter solution) to dissolve the anodized film and measuring the aluminum weight before and after the immersing.

The sealing is carried out by treating the aluminum support with a boiling water, steam, a sodium silicate solution or a dichromic acid solution.

[3] Manufacturing Method of Image Forming Material

The image forming material of the invention is manufactured by coating the above described light sensitive composition on the above support, and then drying.

A coating solution containing the light sensitive composition of the invention has a pH of preferably 3.8 to 8, and more preferably 4 to 6.5. The coating solution having less than 3.5 does not shows the effects of the invention, and The coating solution exceeding pH results in sensitivity lowering.

The pH in the invention is measured employing a coating solution containing a solid content of 10% by weight, in which the light sensitive composition of the invention is dissolved in an organic solvent, water or a mixture thereof. The pH is measured with a digital pH meter, HM-30S produced by Toa denpa Kogyo Co., Ltd. by standardizing the pH meter, and perpendicularly immersing the pH measuring terminal in the coating solution for 2 minutes.

The pH of the coated layer surface is preferably 4 to 8, and more preferably 5 to 7. The pH of the coated layer is measured employing a presensitized printing plate having a light sensitive layer with a thickness of 2 g/m$^2$ on a support. The pH is measured with a digital pH meter, HM-18B produced by Toa denpa Kogyo Co., Ltd. by standardizing the pH meter, and dropping 1 $\mu$l of water, taken by a micro pipette, and perpendicularly placing the pH measuring terminal in the dropped water for 2 minutes to contact the light sensitive layer.

The coating method includes conventional coating methods such as a whirler coating method, a wire-bar coating method, a dip coating method, an air-knife coating method, a blade coating method and a curtain coating method. The coating amount of the light sensitive layer in the presensitized planographic printing plate is preferably 0.5 to 5.0 g/m$^2$, although it varies depending on the usage.

The actinic light in the invention includes a laser, an emission diode, a xenon flush lamp, a halogen lamp, a carbon arc light, a metal halide lamp, a tungsten lamp, a high pressure mercury lamp, and a non-electrode light source. The actinic light in the invention is preferably a laser. When the laser is used, which can be condensed in the beam form, scanning exposure according to an image can be carried out, and direct writing is possible without using any mask material. When the laser is employed for imagewise exposure, a highly dissolved image can be obtained, since it is easy to condense its exposure spot in minute size. As the laser, argon laser, He-Ne gas laser, YAG laser, semiconductor laser or infrared laser is suitably used. In the invention, semi-conductor laser or infrared laser is preferable, and infrared laser is more preferable.

The image forming material of the invention is preferably imagewise exposed to light having a wavelength of 700 nm or more. The output power is suitably 50 mW or more, and preferably 100 mW or more.

Developer of the image forming material is preferably a developer containing a specific organic solvent, an alkali agent and water as essential components. The specific organic solvent herein referred to is an organic solvent with a solubility in 20° C. water of 10% or less by weight, and when a developer contains the solvent, the developer is capable of dissolving or swelling the light sensitive layer at non-exposed portions (or non-image portions). Such a solvent may be any solvent, as long as it has the above described characteristics. The examples thereof include carboxylates such as ethyl acetate, propyl acetate, butyl acetate, amyl acetate, benzyl acetate, ethylene glycol monobutylacetate, butyl lactate and butyl levulinate, ketones such as ethylbutyl ketone, methylisobutyl ketone and cyclohexanone, alcohols such as ethylene glycol monobutylether, ethylene glycol benzylether, ethylene glycol monophenylether, benzyl alcohol, methylphenyl carbinol, n-amyl alcohol and metyl amyl alcohol, an alkyl-substituted aromatic hydrocarbon such as xylene and halogenated hydrocarbons such as methylene dichloride, ethylene dichloride and monochlorobenzene. The solvent may be used one kind or more. Among these solvents, ethylene glycol monophenylether or benzyl alcohol is especially preferable. The solvent content of the developer is ordinarily 0.001 to 20 weight %, and preferably 0.01 to 10 weight %.

The alkali agent contained in the developer includes sodium silicate, potassium silicate, sodium hydroxide, potassium hydroxide, lithium hydroxide, a di or trisodium phosphate, a di or triammonium phosphate, sodium metasilicate, sodium carbonate, potassium carbonate, ammonia, monomethylamine, dimethylamine, trimethylamine, monoethylamine, diethylamine, triethylamine, monoisopropylamine, diisopropylamine, n-butylamine, monoethanolamine, diethanolamine, triethanolamine, monoisopropanolamine, diisopropanolamine, triisopropanolamine, ethyleneamine and ethylenediamine.

The preferable are potassium silicate, sodium silicate, disodium phosphate, sodium carbonate, sodium bicarbonate, potassium carbonate, monoethanolamine, diethanolamine and triethanolamine. The alkali agent may be used singly or in combination.

The example of the solvent includes ethyl acetate, ethyl acetate. The aqueous alkaline developer includes an aqueous solution containing an alkali metal salt such as sodium hydroxide, potassium hydroxide, sodium carbonate, potassium carbonate, sodium metasilicate, potassium metasilicate or di or trisodium phosphate. The metal salt concentration of the developer is preferably 0.05 to 20% by weight, and more preferably 0.1 to 10% by weight. The developer optionally contains an anionic surfactant, an amphoteric surfactant or an organic solvent such as alcohol. The organic solvent includes propylene glycol, ethylene glycol monophenylether, benzyl alcohol and n-propyl alcohol.

The ordinary content of these alkaline agents in a developing solution is 0.05–8 wt % and preferable content is 0.5–6 wt %.

For further enhancement of storage stability and printing durability, it is preferable to make water-soluble sulfite to be contained in a developing solution as occasion demands. As a sulfite of such type, an alkali metal sulfite or an alkali earth metal sulfite is preferable, and there are given, for example, sodium sulfite, potassium sulfite, lithium sulfite and magnesium sulfite. Ordinary content of these sulfites in a developing solution in terms of its composition is 0.05–4 wt %, and preferable content is 0.1–1 wt %.

For accelerating dissolution of aforesaid specific organic solvent in water, it is also possible to cause a certain solubilizing agent to be contained. As the solubilizing agent mentioned above, it is preferable to use low molecular alcohol and ketones which are aoluble in water more easily than the specific organic solvent to be used. It is also possible to use anionic surfactants and ampholytic surfactants. As alcohol and ketones mentioned above, it is preferable to use methanol, ethanol, propanol, butanol, acetone, methylethyl ketone, ethyleneglycol monomethyl ether, ethyleneglycol monoethyl ether, methoxybutanol, ethoxybutanol, 4-methoxymethylbutanol and N-methylpyrrolidone, for example. Further, as a surfactant, sodium isopropylnaphthalene sulfonate, sodium n-butylnaphthalene sulfonate, sodium N-methyl-N-pentadecylamino acetate, and sodium layrylsulfate are preferable. Though there is no limitation for an amount of the solubilizing agent such as alcohol and ketones to be used, the amount of about 30 wt % or less for the total of a developing solution is generally preferable. A developer and developer replenisher described in Japanese Patent O.P.I. Publication No. 57-7427 are suitably used.

EXAMPLES

Next, the present invention will be explained in the examples. In the examples or comparative examples, all "parts" are by weight, unless otherwise specified.

(Preparation of a Support)

A 0.24 mm thick aluminum plate (material 1050, quality H16) was degreased at 65° C. for one minute in a 5% sodium hydroxide solution, washed with water, neutralized in a 10% sulfuric acid solution at 25° C. for one minute and further washed with water. The resulting plate was electrolytically etched at 25° C. for 60 seconds at an alternating current density of 10 A/dm$^2$ in a 1.0% nitric acid solution, desmut at 60° C. for 10 seconds in a 5% sodium hydroxide solution, and then anodized at 20° C. for one minute at a current density of 3 A/dm$^2$ in a 20% sulfuric acid solution. The resulting aluminum plate was immersed at 80° C. for 30 seconds in a 15% ammonium acetate solution, washed with water and dried at 80° C. for 3 minutes. The resulting plate was further immersed at 85° C. for 30 seconds in a 0.1 weight % carboxymethyl cellulose (CMC) solution, and dried at 85° C. for 5 minutes. Thus, support 1 was obtained.

(Synthesis of Acid Decomposable Compound A)

A mixture of 0.5 mol of 1,1-dimethoxycyclohexane, 1.0 mol of 2-phenoxyethanol, 80 mg of p-toluene sulfonic acid and 300 ml of toluene was reacted at 120° C. for 8 hours with stirring, while methanol produced during reaction was removed. The reaction mixture solution was cooled, washed with water, an equeous sodium hydroxide solution, washed with an aqueous saturated sodium chloride solution to be neutralized, and dried over anhydrous potassium carbonate. The solvent (toluene) of the resulting solution was removed by evaporation under reduced pressure to obtain white crystals. Thus, an acid decomposable compound A represented by the formula described later was obtained.

Example 1

(Preparation of Light Sensitive Composition 1, Positive Working)

Light sensitive composition 1 having the following composition was prepared.

| | |
|---|---|
| Binder A (copolycondensate of phenol, m-cresol and p-cresol with formaldehyde, phenol/m-cresol/p-cresol = 20/48/32 by molar ratio, Mw = 2500) | 60.75 parts |
| Binder B (shown below and in Table 1) | 15 parts |
| Acid decomposable compound A | 20 parts |
| Acid generating compound (Exemplified compound (1)) | 3 parts |
| Cyanine dye (Exemplified infrared absorber IR-48) | 1 part |
| Surfactant S-381 (produced by Asahi Glass Co. Ltd.) | 0.25 parts |
| Solvent (PGM) PGM: propylene glycol monomethylether | 1000 parts |
| Acid decomposable compound A | |

-continued

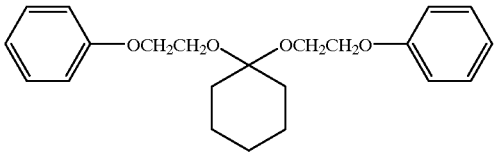

Binder B (n:m:o:p = 35:14:3:48, by weight ratio)

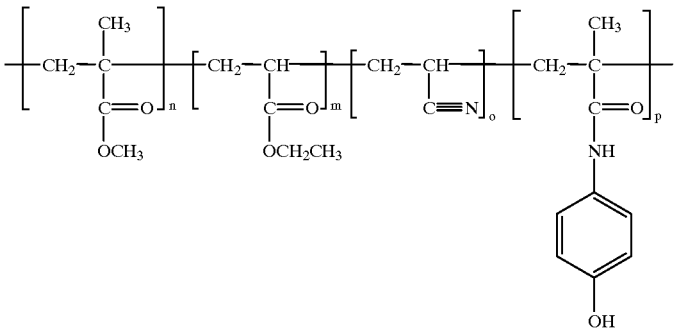

MMA EA AN HypMA (Preparation of Image Forming Material)

The above light sensitive composition 1 was coated on support 1 prepared above with a wire bar, and dried at 95° C. for 90 seconds to obtain a light sensitive layer with a dry thickness of 2.0 g/m$^2$. Thus, an image forming material sample 1 (hereinafter referred to as presensitized planographic printing plate 1) was prepared.

(Preparation of Light Sensitive Composition 2, Negative Working)

| | |
|---|---|
| Binder A | 50 parts |
| Binder B | 10 parts |

-continued

| | |
|---|---|
| Acid cross-linkable resin, resol resin Shonol CKP-918 produced by Showa Kobunshi Co., Ltd.) | 35.75 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| Solvent (PGM) | 1000 parts |

TABLE 1

| Polymer No. | Polymer composition (weight %) | Unit (a) | Unit (b) | Y | SP value | Molecular weight* | Acid value (mg KOH/g) |
|---|---|---|---|---|---|---|---|
| A | ph/m-cresol/p-cresol 20/48/32 | — | — | — | m-C11.4, ph 14.5 | 2500 | 101 |
| B | MMA/EA/AN/HyPMA 35/14/3/48 | AN | Others | — | HyPMA 14.21 | 38000 | — |
| C | MMA/EA/AN/MAmi 35/14/3/48 | AN MAmi | Others | — | MAmi 16.42 | 30000 | — |
| D | MMA/EA/AN/AAni-MAni 35/14/3/48 | AN | Others | — | AAni-MAni 13.16 | 35000 | — |
| E | MMA/EA/AN/HEMA 35/14/3/48 | AN | Others | — | HEMA 10.81 | 35000 | — |
| F | HyPMA/AN/BzMA/MMA 54/24/16/6 | AN | Others | 2.84 | AN 11.12 | 35000 | — |
| G | HyPMA/BzMA/CyPMAmi 36/26.5/37.5 | CyPMAmi | Others | 3.17 | CyPMAmi 12.87 | 30000 | — |
| H | HyPMA/BzMA/CyPMA 36/26.5/37/5 | CyPMA | Others | 3.14 | CyPMA 14.48 | 30000 | — |
| I | MAA/BzMA/MMA 21.5/44.5/34 | — | All | 1.77 | MMA 8.93 | 30000 | 400 |
| J | CyPMA/MAA 90/10 | CyPMA | MAA | 4.33 | CyPMA 14.48 | 30000 | 200 |
| K | MAA/BzMA/MMA 0.5/63.5/36 | — | All | — | — | 30000 | 2.46 |
| L | MMA/EA/AN/AmiMAni 35/14/3/48 | AmiMAni | Others | — | — | 35000 | — |
| M | MMA/EA/AN/2MAEA 35/14/3/48 | AN | Others | — | 2MAEA 10.1 | 25000 | — |
| N | MMA/AN/HyPMA/MAmi 20/30/20/30 | AN MAmi | Others | — | AN 11.12<br>MAmi 16.42 | 30000 | — |
| O | MAA/AN/HyPMim/MAmi 20/30/20/30 | AN MAmi | Others | — | AN 11.12<br>MAmi 16.42 | 30,000 95%**<br>1,000,000 5% | — |

TABLE 1-continued

| Polymer No. | Polymer composition (weight %) | Unit (a) | Unit (b) | Y | SP value | Molecular weight* | Acid value (mg KOH/g) |
|---|---|---|---|---|---|---|---|
| P | MMA/AN/BPh/MAmi 20/30/20/30 | AN Mami | Others | — | AN 11.12<br>MAmi 16.42 | 30,000 95%<br>1,000,000 5% | — |
| Q | MMA/AN/HyPMA/MAmi 20/30/20/30 | AN MAmi | Others | — | AN 11.12<br>MAmi 16.42 | 30,000 95%<br>1,000,000 5% | — |

*** AAni-Mani: 4'-acetoanilide-methacrylanilide
AmiMAni: 4'-amido-methacrylanilide
2MAEA: N,N-dimethylaminoethylacrylate
HyPMim: N-hydroxyphenylmaleimide
BPh: Vinylphenol
HEMA: 2-hydroxyethylmethacrylate
MAmi: methacrylamide
EA: ethyl acrylate
*weight average molecular weight
**weight %

***

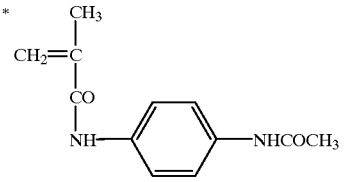

(Preparation of Image Forming Material)

The above light sensitive composition 2 was coated on support 1 prepared above in the same manner as in light sensitive composition 1 above. Thus, an image forming material sample 2 (hereinafter referred to as presensitized planographic printing plate 2) was prepared.

The resulting image forming material samples were processed as follows to form an image, and evaluated.

(Image Forming)

Presensitized planographic printing plate 1 was image-wise exposed to a semiconductor laser (having a wavelength of 830 nm and an output of 500 mW). The laser light spot diameter was 13 $\mu$m at $1/e^2$ of the peak intensity. The resolving degree was 2,000 dpi in both the main and the sub scanning directions. The exposed plate was developed at 30 ° C. in 30 seconds with developer, in which a planographic printing plate developer, SDR-1 (produced by Konica Corporation) was diluted 6 times by volume with water, to remove non-image portions (exposed portions), washed with water, and dried. Thus, printing plate 1 having a positive image was obtained. Presensitized planographic printing plate 2 was processed in the same manner as in Presensitized planographic printing plate 1 except that non-exposed portions were removed. Thus, printing plate 1 having a negative image was obtained.

Evaluation (Sensitivity)

Sensitivity was represented in terms of exposure energy (mj/cm$^2$) necessary to form an image when a presensitized planographic printing plate was exposed and then developed under the above conditions.

(Development Latitude)

Each presensitized planographic printing plate was processed in the same manner as above, except that developer in which 1 part of SDR-1 and 3 parts of water were mixed, developer in which 1 part of SDR-1 and 5 parts of water were mixed, and developer in which 1 part of SDR-1 and 9 parts of water were mixed were used. Stain occurrence were evaluated at non-image portions of the resulting plate according to the following evaluation criteria:

○: No stain occurrence was observed.

Δ: Slight stain occurrence was observed.

X: Stain markedly occurred.

(Storage Stability)

Each presensitized planographic printing plate was processed in the same manner as above, after the plate had been placed at 55° C. and 20% RH for 3 days or at 40° C. and 80% RH for 3 days in a thermostat produced by TABI ESPEC CORP. The resulting plate was evaluated for developability according to the following evaluation criteria:

○: Non-image portions were completely removed without damage of the image portions.

Δ: Slight light sensitive layer remained at non-image portions.

X: Light sensitive layer was not completely removed at some non-image portions.

(Chemical Resistance)

The developed plate was immersed in Ultra Plate Cleaner (produced by Dainichi Seika Co., Ltd.) for 15, 30 and 60 minutes, and washed with water. The image portions after the immersing was visually observed, as compared to those before the immersing, and evaluated according to the following criteria:

5: No damage at image portions

4: Some image portions were slightly damaged, but no problem.

3: Image portions were slightly damaged, but not so damaged that the image portions were removed to expose the surface of the support.

2: Some image portions were removed to partially expose the surface of the support.

1: Image portions were completely removed to expose the surface of the support.

Image forming material samples 3 through 10 were prepared in the same manner as above, except that binders as shown in Table 2 were used. The resulting image forming material samples were processed to form an image and evaluated in the same manner as above. The results are shown in Table 2.

TABLE 2

| Sample No. | Polymer used | Developer (Ref.) (SDR-1/water = 1/5) Sensitivity (mJ/cm²2) | Stains at non-image portions | Development Latitude: Developer (SDR-1/water = ⅓) Sensitivity (mJ/cm²) | Stains at non-image portions | Development Latitude: Developer (SDR-1/water= 1/9) Sensitivity (mJ/cm²) | Stains at non-image portions | Sensitivity fluctuation (developed with developer (Ref.)): DT (55° C./20% RH) Sensitivity (mJ/cm²) | Stains at non-image portions | LHT (40° C./80% RH) Sensitivity (mJ/cm²) | Stains at non-image portions | Chemical resistance UPC resistance: 15 minutes | 60 minutes | 90 minutes |
|---|---|---|---|---|---|---|---|---|---|---|---|---|---|---|
| 1 | A + B | 200 | ○ | 200 | ○ | 220 | ○ | 200 | ○ | 200 | ○ | 5 | 5 | 3 |
| 2 | A + B | 350 | ○ | 400 | ○ | 350 | ○ | 400 | ○ | 400 | ○ | 5 | 5 | 5 |
| 3 | A + C | 300 | ○ | 300 | ○ | 300 | ○ | 300 | ○ | 300 | ○ | 5 | 5 | 5 |
| 4 | A + C | 350 | ○ | 350 | ○ | 350 | ○ | 350 | ○ | 350 | ○ | 5 | 5 | 5 |
| 5 | A + D | 350 | ○ | 350 | ○ | 350 | ○ | 350 | ○ | 350 | ○ | 5 | 5 | 5 |
| 6 | A + D | 400 | ○ | 400 | ○ | 400 | ○ | 400 | ○ | 400 | ○ | 5 | 5 | 5 |
| 7 | A + E | 200 | ○ | 200 | ○ | 250 | ○ | 250 | ○ | 250 | ○ | 3 | 1 | 1 |
| 8 | A + E | 300 | ○ | 300 | ○ | 300 | ○ | 350 | ○ | 350 | ○ | 5 | 1 | 1 |
| 9 | A | 300 | ○ | 400 | ○ | 400 | ○ | >500 | X | 400 | ○ | 1 | 1 | 1 |
| 10 | A | 300 | ○ | 400 | ○ | 300 | ○ | >500 | X | 400 | ○ | 1 | 1 | 1 |

As is apparent from Table 2, negative or positive working image forming material samples 1 through 6, comprising a polymer having a monomer unit from an unsaturated monomer with an SP value of 13 or more, can form an image by infrared ray exposure, and provide high sensitivity to infrared rays, excellent developability, and excellent chemical resistance.

Example 2

(Preparation of Light Sensitive Composition 1, Positive Working)

Light sensitive composition having the following composition was prepared.

| | |
|---|---|
| Binder A | 60.75 parts |
| Binder F (as shown in Tables 1 and 3) | 15 parts |
| Acid decomposable compound A | 20 parts |
| Acid generating compound (Exemplified compound (1)) | 3 parts |
| Cyanine dye (Exemplified infrared absorber IR-48) | 1 part |
| Surfactant S-381 (produced by Asahi Glass Co. Ltd.) | 0.25 parts |
| Solvent (PGM) | 1000 parts |

(Preparation of Image Forming Material)

The above light sensitive composition 1 was coated on the support 1 prepared above with a wire bar, and dried at 95° C. for 90 seconds to obtain a light sensitive layer with a dry thickness of 2.0 g/m². Thus, an image forming material sample 1 (presensitized planographic printing plate) was prepared.

(Preparation of Light Sensitive Composition 2, Negative Working)

| | |
|---|---|
| Binder A | 50 parts |
| Binder F (as shown in Tables 1 and 3) | 10 parts |
| Acid cross-linkable resin, resol resin Shonol CKP-918 | 35.75 parts |

-continued

| | |
|---|---|
| produced by Showa Kobunshi Co., Ltd.) | |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| Solvent (PGM) | 1000 parts |

TABLE 3

| Monomer (Abbreviation) | Monomer | Dipole moment (D) |
|---|---|---|
| HyPMA | 4-hydroxyphenylmethacrylamide | 2.382 |
| AN | Acrylonitrile | 3.500 |
| MMA | Methyl methacrylate | 1.770 |
| MAA | Methacrylic acid | 2.441 |
| MA | Methyl acrylate | 1.770 |
| BzMA | Benzyl methacrylate | 1.770 |
| CyPMAmi | 3-Cyanophenyl methacrylamide | 4.800 |
| CyPMA | 4-Cyanophenyl methacrylate | 4.730 |
| Ph | Phenol | — |
| m-C | m-Cresol | — |
| p-C | p-Cresol | — |

(Preparation of Image Forming Material)

The above light sensitive composition 2 was coated on the support prepared in Example 1 in the same manner as in image forming material sample 1. Thus, an image forming material sample 2 was prepared.

Image forming material samples 3 through 6 were prepared in the same manner as above, except that binders as shown in Table 4 were used. The resulting image forming material samples were processed to form an image and evaluated in the same manner as in Example 1. The results are shown in Table 4.

TABLE 4

| | | | | Development Latitude | | | | Sensitivity fluctuation (developed with developer (Ref.) | | | | | | |
|---|---|---|---|---|---|---|---|---|---|---|---|---|---|---|
| | | Developer (Ref.) (SDR-1/water = 1/5) | | Developer (SDR-1/water = ⅓) | | Developer (SDR-1/water= 1/9) | | DT (55° C./20% RH) | | LHT (40° C./80% RH) | | Chemical resistance UPC resistance | | |
| Sample No. | Polymer used | Sensitivity (mJ/cm$^2$2) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | 15 minutes | 60 minutes | 90 minutes |
| 1 | A + F | 200 | ○ | 200 | ○ | 200 | ○ | 200 | ○ | 200 | ○ | 5 | 5 | 5 |
| 2 | A + F | 250 | ○ | 300 | ○ | 250 | ○ | 300 | ○ | 300 | ○ | 5 | 5 | 5 |
| 3 | A + G | 400 | ○ | 400 | ○ | 400 | ○ | 400 | ○ | 400 | ○ | 5 | 5 | 5 |
| 4 | A + G | 300 | ○ | 300 | ○ | 300 | ○ | 300 | ○ | 300 | ○ | 5 | 5 | 5 |
| 5 | A + H | 350 | ○ | 350 | ○ | 350 | ○ | 350 | ○ | 350 | ○ | 5 | 5 | 5 |
| 6 | A + H | 250 | ○ | 250 | ○ | 250 | ○ | 250 | ○ | 250 | ○ | 5 | 5 | 5 |

As is apparent from Table 4, negative or positive working image forming material samples 1 through 6, comprising a polymer with Y represented by formula (1) being from 1.8 to 4.0 containing (a) a first monomer unit from a first monomer with a dipole moment of 3.0 D or more and (b) a second monomer unit from a second monomer with a dipole moment of less than 3.0 D, can form an image by infrared ray exposure, and provide high sensitivity to infrared rays, excellent developability, and excellent chemical resistance.

Example 3

(Preparation of Light Sensitive Composition 1, Positive Working)

Light sensitive composition having the following composition was prepared.

| | |
|---|---|
| Binder A | 60.75 parts |
| Binder L (as shown in Table 1) | 15 parts |
| Acid decomposable compound A | 20 parts |
| Acid generating compound (Exemplified compound (1)) | 3 parts |
| Cyanine dye (Exemplified infrared absorber IR-48) | 1 part |
| Surfactant S-381 (produced by Asahi Glass Co. Ltd.) | 0.25 parts |
| Solvent (PGM) | 1000 parts |

(Preparation of Image Forming Material)

The above light sensitive composition 1 was coated on the support 1 prepared above with a wire bar, and dried at 95° C. for 90 seconds to obtain a light sensitive layer with a dry thickness of 2.0 g/m$^2$. Thus, an image forming material sample 1 (presensitized planographic printing plate) was prepared.

(Preparation of Light Sensitive Composition 2, Negative Working)

| | |
|---|---|
| Binder A | 50 parts |
| Binder L (as shown in Table 1) | 10 parts |
| Acid cross-linkable resin, resol resin Shonol CKP-918 produced by Showa Kobunshi Co., Ltd.) | 35.75 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| Solvent (PGM) | 1000 parts |

(Preparation of Image Forming Material)

The above light sensitive composition 2 was coated on the support 1 prepared above in the same manner as in image forming material sample 1. Thus, an image forming material sample 2 was prepared.

Image forming material samples 3 through 14 were prepared in the same manner as above, except that binders as shown in Table 5 were used. The resulting image forming material samples were processed to form an image and evaluated in the same manner as in Example 1. The results are shown in Table 5.

TABLE 5

| | | | | Development Latitude | | | | Sensitivity fluctuation (developed with developer (Ref.) | | | | | | |
|---|---|---|---|---|---|---|---|---|---|---|---|---|---|---|
| | | Developer (Ref.) (SDR-1/water = 1/5) | | Developer (SDR-1/water = ⅓) | | Developer (SDR-1/water= 1/9) | | DT (55° C./20% RH) | | LHT (40° C./80% RH) | | Chemical resistance UPC resistance | | |
| Sample No. | Polymer used | Sensitivity (mJ/cm$^2$2) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | 15 minutes | 60 minutes | 90 minutes |
| 1 | A + L | 200 | ○ | 200 | ○ | 200 | ○ | 250 | ○ | 200 | ○ | 5 | 5 | 5 |
| 2 | A + L | 250 | ○ | 250 | ○ | 250 | ○ | 200 | ○ | 250 | ○ | 5 | 5 | 5 |
| 3 | A + N | 200 | ○ | 150 | ○ | 250 | ○ | 250 | ○ | 250 | ○ | 5 | 5 | 5 |
| 4 | A + N | 200 | ○ | 200 | ○ | 200 | ○ | 250 | ○ | 250 | ○ | 5 | 5 | 5 |
| 5 | A + O | 150 | ○ | 150 | ○ | 150 | ○ | 200 | ○ | 150 | ○ | 5 | 5 | 5 |
| 6 | A + O | 200 | ○ | 150 | ○ | 250 | ○ | 200 | ○ | 200 | ○ | 5 | 5 | 5 |
| 7 | A + P | 150 | ○ | 150 | ○ | 150 | ○ | 200 | ○ | 150 | ○ | 5 | 5 | 5 |
| 8 | A + P | 200 | ○ | 150 | ○ | 250 | ○ | 200 | ○ | 200 | ○ | 5 | 5 | 5 |
| 9 | A + Q | 200 | ○ | 200 | ○ | 200 | ○ | 300 | ○ | 300 | ○ | 5 | 5 | 5 |
| 10 | A + Q | 300 | ○ | 300 | ○ | 300 | ○ | 350 | ○ | 350 | ○ | 5 | 5 | 5 |
| 11 | A + E | 200 | ○ | 200 | ○ | 250 | ○ | >500 | ○ | >500 | X | 1 | 1 | 1 |
| 12 | A + E | 300 | ○ | 300 | ○ | 300 | ○ | >500 | ○ | >500 | ○ | 1 | 1 | 1 |
| 13 | A | 300 | ○ | 400 | ○ | 400 | ○ | >500 | X | >500 | X | 5 | 5 | 5 |
| 14 | A | 300 | ○ | 400 | ○ | 300 | ○ | >500 | X | >500 | X | 5 | 5 | 5 |

As is apparent from Table 5, negative or positive working image forming material samples 1 through 10, comprising a polymer having an amido group, can form an image by infrared ray exposure, and provide high sensitivity to infrared rays, excellent developability, and excellent chemical resistance.

Example 4

(Preparation of Light Sensitive Composition 1, Positive Working)

Light sensitive composition having the following composition was prepared.

| | |
|---|---|
| Binder A | 60.75 parts |
| Binder K (as shown in Table 1) | 15 parts |
| Acid decomposable compound A | 20 parts |
| Acid generating compound (Exemplified compound (1)) | 3 parts |
| Cyanine dye (Exemplified infrared absorber IR-48) | 1 part |
| Surfactant S-381 (produced by Asahi Glass Co. Ltd.) | 0.25 parts |
| Solvent (PGM) | 1000 parts |

(Preparation of Image Forming Material)

The above light sensitive composition 1 was coated on the support prepared in Example 1 with a wire bar, and dried at 95° C. for 90 seconds to obtain a light sensitive layer with a dry thickness of 2.0 g/m$^2$. Thus, an image forming material sample 1 (presensitized planographic printing plate) was prepared.

(Preparation of Light Sensitive Composition 2, Negative Working)

| | |
|---|---|
| Binder A | 50 parts |
| Binder K (as shown in Table 1) | 10 parts |
| Acid cross-linkable resin, resol resin Shonol CKP-918 produced by Showa Kobunshi Co., Ltd.) | 35.75 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| Solvent (PGM) | 1000 parts |

(Preparation of Image Forming Material)

The above light sensitive composition 2 was coated on the support 1 prepared above in the same manner as in image forming material sample 1. Thus, an image forming material sample 2 was prepared.

The resulting image forming material samples were processed to form an image and evaluated in the same manner as in Example 1. The results are shown in Table 6.

TABLE 6

| | | | | Development Latitude | | | | Sensitivity fluctuation (developed with developer (Ref.) | | | | | | |
|---|---|---|---|---|---|---|---|---|---|---|---|---|---|---|
| | | Developer (Ref.) (SDR-1/water = 1/5) | | Developer (SDR-1/water = ⅓) | | Developer (SDR-1/water= 1/9) | | DT (55° C./20% RH) | | LHT (40° C./80% RH) | | Chemical resistance UPC resistance | | |
| Sample No. | Polymer used | Sensitivity (mJ/cm$^2$2) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | 15 minutes | 60 minutes | 90 minutes |
| 1 | A + K | 300 | ○ | 300 | ○ | 350 | ○ | 350 | ○ | 350 | ○ | 5 | 3 | 3 |
| 2 | A + K | 350 | ○ | 350 | ○ | 300 | ○ | 350 | ○ | 350 | ○ | 5 | 4 | 3 |

As is apparent from Table 6, negative or positive working image forming material samples 1 and 2, comprising a polymer having an acid value of 5 or less, can form an image by infrared ray exposure, and provide excellent storage stability (reduced sensitivity fluctuation after long-term storage), high sensitivity to infrared rays, excellent developability, and excellent chemical resistance.

Example 5

(Preparation of Light Sensitive Composition 1, Positive Working)

Light sensitive composition having the following composition was prepared.

| | |
|---|---|
| Binder A | 60.75 parts |
| Binder M (as shown in Table 1) | 15 parts |
| Acid decomposable compound A | 20 parts |
| Acid generating compound (Exemplified compound (1)) | 3 parts |
| Cyanine dye (Exemplified infrared absorber IR-48) | 1 part |
| Surfactant S-381 (produced by Asahi Glass Co. Ltd.) | 0.25 parts |
| Solvent (PGM) | 1000 parts |

(Preparation of Image Forming Material)

The above light sensitive composition 1 was coated on the support 1 prepared above with a wire bar, and dried at 95° C. for 90 seconds to obtain a light sensitive layer with a dry thickness of 2.0 g/M$^2$. Thus, an image forming material sample 1 (presensitized planographic printing plate) was prepared.

(Preparation of light sensitive composition 2, negative working)

| | |
|---|---|
| Binder A | 50 parts |
| Binder M (as shown in Table 1) | 10 parts |
| Acid cross-linkable resin, resol resin Shonol CKP-918 produced by Showa Kobunshi Co., Ltd.) | 35.75 parts |
| Acid generating compound (Exemplified compound (1)) | 3 parts |
| Cyanine dye (Exemplified infrared absorber IR-25) | 1 part |
| Surfactant S-381 (produced by Asahi Glass Co. Ltd.) | 0.25 part |
| Solvent (PGM) | 1000 parts |

(Preparation of Image Forming Material)

The above light sensitive composition 2 was coated on the support 1 prepared above with in the same manner as in image forming material sample 1. Thus, an image forming material sample 2 was prepared.

Image forming material samples 3 through 6 were prepared in the same manner as above, except that binders as shown in Table 7 were used. The resulting image forming material samples were processed to form an image and evaluated in the same manner as in Example 1. The results are shown in Table 7.

TABLE 7

| | | | | Development Latitude | | | | Sensitivity fluctuation (developed with developer (Ref.) | | | | | | |
|---|---|---|---|---|---|---|---|---|---|---|---|---|---|---|
| | | Developer (Ref.) (SDR-1/water = 1/5) | | Developer (SDR-1/water = ⅓) | | Developer (SDR-1/water= 1/9) | | DT (55° C./20% RH) | | LHT (40° C./80% RH) | | Chemical resistance UPC resistance | | |
| Sample No. | Polymer used | Sensitivity (mJ/cm$^2$2) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | Sensitivity (mJ/cm$^2$) | Stains at non-image portions | 15 minutes | 60 minutes | 90 minutes |
| 1 | A + L | 300 | ○ | 300 | ○ | 300 | ○ | 300 | ○ | 300 | ○ | 5 | 5 | 5 |
| 2 | A + M | 400 | ○ | 350 | ○ | 400 | ○ | 400 | ○ | 400 | ○ | 5 | 5 | 5 |
| 3 | A + E | 200 | ○ | 200 | ○ | 250 | ○ | 250 | ○ | 250 | ○ | 3 | 1 | 1 |
| 4 | A + E | 300 | ○ | 300 | ○ | 300 | ○ | 350 | ○ | 350 | ○ | 5 | 1 | 1 |
| 5 | A | 300 | ○ | 400 | ○ | 400 | ○ | >500 | X | 400 | ○ | 1 | 1 | 1 |
| 6 | A | 300 | ○ | 400 | ○ | 300 | ○ | >500 | X | 400 | ○ | 1 | 1 | 1 |

As is apparent from Table 7, negative or positive working image forming material samples 1 and 2, comprising a polymer having an amino group, can form an image by infrared ray exposure, and provide excellent storage stability (reduced sensitivity fluctuation after long-term storage), high sensitivity to infrared rays, excellent developability, and excellent chemical resistance.

What is claimed is:

1. A light sensitive composition comprising a compound capable of generating an acid on exposure of actinic light, one of a compound having a chemical bond capable of being decomposed by an acid and a compound having a group cross-linking by an acid, an infrared absorber, and a polymer obtained by polymerization of a polymerizable composition comprising an ethylenically unsaturated monomer having a solubility parameter (SP value) of 13 or more.

2. The light sensitive composition of claim 1, wherein the polymer content of the light sensitive composition is 5 to 80 weight %.

3. The light sensitive composition of claim 1, wherein said polymer includes a polymer having an amido group.

4. The light sensitive composition of claim 3, wherein said polymer has a solubility parameter of 10 or more.

5. The light sensitive composition of claim 4, wherein said polymer includes a polymer having in its chemical structure at least one unit selected from the group consisting of the following formulas (a), (b), (c), (d), (e), (f), (g), and (h):

Formula (a)

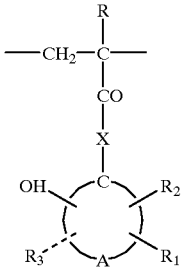

-continued

Formula (b)

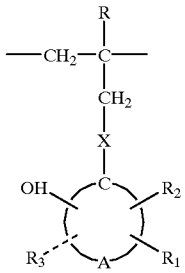

Formula (c)

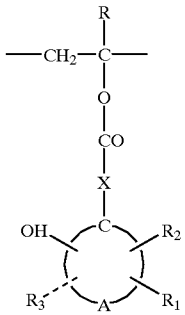

Formula (d)

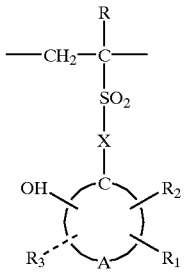

-continued

Formula (e)

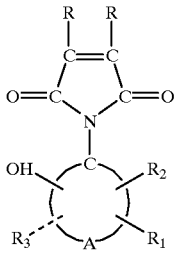

Formula (f)

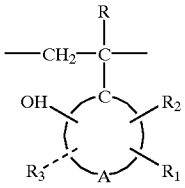

Formula (g)

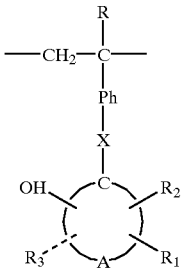

Formula (h)

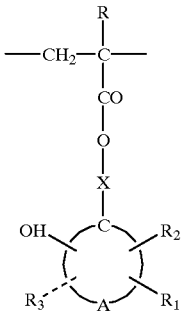

wherein R represents a hydrogen atom, a phenyl group or an alkyl group; $R_1$, $R_2$ and $R_3$ independently represent a hydrogen atom, an alkyl group, a sulfoamino group, a halogen atom, an alkoxycarbonyl group, a carbonyl group, an aryl group, an acyloxy group, an aralkyl group, an aryloxy group, an acryloyl group, an acyl group, an aminocarbonyl group or an alkoxy group; X represents an ether group, an ester group, an alkylene group, an arylene group, an alkylenecarbonyloxy or arylenecarbonyloxy group, an amido group, a sulfonylamino group, an imino group, an alkyleneoxy group, or an aryleneoxy group; and A represents a non-metallic atom group necessary to form an aromatic ring group.

6. The light sensitive composition of claim 3, wherein said polymer having an amido group further has a phenolic hydroxy group.

7. The light sensitive composition of claim 6, wherein in said polymer, the amido group-containing unit content is 5 to 50 weight %, and the phenolic hydroxy group-containing unit content is 10 to 80 weight %.

8. The light sensitive composition of claim 3, wherein the weight average molecular weight (Mw) of said polymer is $10^4$ to $10^8$.

9. The light sensitive composition of claim 8, comprising a mixture of the polymer having a weight average molecular weight (Mw) of $10^4$ to $5\times10^4$ and the polymer having a weight average molecular weight (Mw) of $10^5$ to $10^7$.

10. The light sensitive composition of claim 1, further comprising a novolak resin.

11. The light sensitive composition of claim 1, wherein said polymer has an acid value of 5 or less.

12. A light sensitive composition comprising a compound capable of generating an acid on exposure of actinic light, one of a compound having a chemical bond capable of being decomposed by an acid and a compound having a group cross-linking by an acid, an infrared absorber, and a polymer obtained by polymerization of a polymerizable composition comprising (a) a first monomer with a dipole moment of 3.0 D or more and (b) a second monomer with a dipole moment of less than 3.0 D, and Y represented by the following formula (1) being from 1.8 to 4.0:

formula (1)

$$Y=\Sigma(\mu a\times Ma)/100+\Sigma(\mu b\times Mb)/100$$

wherein $\mu a$ represents a dipole moment of the first monomer, $\mu b$ represents a dipole moment of the second monomer, Ma represents a polymerized first monomer content (mol %) of the polymer, and Mb represents a polymerized second monomer content (mol %) of the polymer.

13. The light sensitive composition of claim 12, wherein the polymer content of the light sensitive composition is 5 to 80 weight %.

14. The light sensitive composition of claim 12, wherein said polymer has an acid value of 5 or less.

15. A light sensitive composition comprising a compound capable of generating an acid on exposure of actinic light, one of a compound having a chemical bond capable of being decomposed by an acid and a compound having a group cross-linking by an acid, an infrared absorber, and a polymer having an amino group.

16. The light sensitive composition of claim 15, wherein the polymer content of the light sensitive composition is 5 to 80 weight %.

17. The light sensitive composition of claim 15, wherein said polymer has an acid value of 5 or less.

* * * * *